US008002400B2

(12) United States Patent
Kibayashi et al.

(10) Patent No.: US 8,002,400 B2
(45) Date of Patent: Aug. 23, 2011

(54) PROCESS AND APPARATUS FOR FORMING PATTERN

(75) Inventors: Susumu Kibayashi, Kanagawa (JP); Hiroaki Satoh, Kanagawa (JP); Akira Mihara, Kanagawa (JP); Masahiko Fujii, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1316 days.

(21) Appl. No.: 11/599,941

(22) Filed: Nov. 15, 2006

(65) Prior Publication Data

US 2007/0165204 A1 Jul. 19, 2007

(30) Foreign Application Priority Data

Jan. 18, 2006 (JP) ..... 2006-009692

(51) Int. Cl.
*B41J 2/01* (2006.01)
*B41J 2/015* (2006.01)

(52) U.S. Cl. ..... 347/103; 347/101; 347/21

(58) Field of Classification Search ..... 347/103, 347/101, 21

See application file for complete search history.

(56) References Cited

U.S. PATENT DOCUMENTS 3,368,894 A * 2/1968 Matkan et al. ..... 430/117.4
4,210,080 A * 7/1980 Gundlach ..... 346/74.2
5,132,706 A * 7/1992 Yuasa et al. ..... 346/140.1
5,142,306 A * 8/1992 Arahara et al. ..... 346/140.1
5,204,716 A * 4/1993 Kasahara et al. ..... 355/24
5,365,261 A * 11/1994 Ozawa et al. ..... 347/103
6,029,036 A * 2/2000 Itaya et al. ..... 399/239
6,231,164 B1 * 5/2001 Shibata et al. ..... 347/55
6,327,445 B1 * 12/2001 Honda et al. ..... 399/45
6,385,405 B1 * 5/2002 Kingsland ..... 399/2
6,402,317 B2 * 6/2002 Yanagawa et al. ..... 347/104
6,422,696 B1 * 7/2002 Takahashi et al. ..... 347/103
6,460,973 B1 * 10/2002 Takahashi et al. ..... 347/55
6,481,840 B1 * 11/2002 Mueller et al. ..... 347/88
6,585,364 B2 * 7/2003 Kasperchik et al. ..... 347/98
6,650,350 B2 * 11/2003 Suzuki et al. ..... 347/212
6,682,189 B2 * 1/2004 May et al. ..... 347/103
6,716,562 B2 * 4/2004 Uehara et al. ..... 430/125.3
6,719,423 B2 * 4/2004 Chowdry et al. ..... 347/103
6,736,500 B2 * 5/2004 Takahashi et al. ..... 347/103
7,281,790 B2 * 10/2007 Mouri et al. ..... 347/103

(Continued)

FOREIGN PATENT DOCUMENTS

JP 61163885 A * 7/1986

(Continued)

*Primary Examiner* — Stephen D Meier
*Assistant Examiner* — Leonard S Liang
(74) *Attorney, Agent, or Firm* — Fildes & Outland, P.C.

(57) ABSTRACT

A pattern forming process and a pattern forming apparatus comprising forming a liquid receptive particle layer on an intermediate transfer body in a specified area by using liquid receptive particles capable of receiving a recording liquid containing a recording material; applying a liquid droplet of the recording liquid on a specified position of liquid receptive particle layer according to specified data, trapping the recording material near the surface of the liquid receptive particle layer on the intermediate transfer body, and forming a pattern of the recording material near the surface of the liquid receptive particle layer; and removing the liquid receptive particle layer provided with the recording liquid from the intermediate transfer body so that the pattern may be positioned between the transfer object and the liquid receptive particle layer, and transferring the liquid receptive particle layer to the transfer object.

14 Claims, 21 Drawing Sheets

U.S. PATENT DOCUMENTS

| | | | | |
|---|---|---|---|---|
| 7,661,809 | B2 * | 2/2010 | Taniuchi et al. | 347/103 |
| 7,677,717 | B2 * | 3/2010 | Islam et al. | 347/103 |
| 2004/0036754 | A1 * | 2/2004 | Tanikawa et al. | 347/103 |
| 2004/0182270 | A1 * | 9/2004 | Wiedemer et al. | 101/465 |
| 2005/0110855 | A1 * | 5/2005 | Taniuchi et al. | 347/103 |
| 2006/0284951 | A1 * | 12/2006 | Ikeda et al. | 347/103 |
| 2007/0120933 | A1 * | 5/2007 | Mueller | 347/103 |
| 2007/0165204 | A1 * | 7/2007 | Kibayashi et al. | 355/78 |
| 2009/0207226 | A1 * | 8/2009 | Ikeda et al. | 347/103 |
| 2009/0213201 | A1 * | 8/2009 | Numata et al. | 347/103 |

FOREIGN PATENT DOCUMENTS

| | | | |
|---|---|---|---|
| JP | 01253766 | A * | 10/1989 |
| JP | 05096720 | A * | 4/1993 |
| JP | 06008414 | A * | 1/1994 |
| JP | 7-89067 | | 4/1995 |
| JP | 11-188858 | | 7/1999 |
| JP | 11188858 | A * | 7/1999 |
| JP | 2003-80764 | | 3/2003 |

* cited by examiner

APPLICATION TIMING CORRESPONDING TO PAPER SIZE

APPLICATION TIMING CORRESPONDING TO IMAGE

PROCESS AND APPARATUS FOR FORMING PATTERN

BACKGROUND OF THE INVENTION

1. Technical Field

The present invention relates to a pattern forming method and a pattern forming apparatus using a liquid droplet injecting method, and more particularly to a pattern forming method and a pattern forming apparatus by intermediate transfer recording system characterized by recording a pattern on an intermediate transfer body surface, and transferring the pattern on a transfer object and forming the pattern.

2. Related Art

An image forming apparatus of ink jet recording process had various problems, such as a problem of change of printed state depending on difference in recording medium (for example, difference in permeation of ink), and a problem of disturbance of image in undried portion of ink image when using a recording medium not allowing the ink to permeate, when discharging the recording medium or when inverting the sides in two-side printing.

In image forming by ink jet, ink is directly injected onto the recording medium depending on an image signal, and characters or an image is formed. Recently, owing to enhancement in image forming speed, an FWA (Full Width Array) recording apparatus, having nozzles disposed in the overall width of recording medium to be conveyed, is needed. In such a FWA type of recording device, the time required for discharging the recording medium on which characters, images or the like have been formed becomes shorter, and the time taken for drying ink permeated into the recording medium becomes shorter, when compared to conventional scanning type recording devices.

Deterioration of images may be generated when, just after printing, the surface is rubbed or is pressed by rollers as ink on the printed surface has not been sufficiently fixed. Especially when undertaking double sided recording, productivity decreases because a certain period of drying time is required in order that the above deterioration in images does not occur.

In order to promote evaporation of solvents contained in inks on impermeable papers, in particular, if a drying unit such as heater is installed in the apparatus, a large amount of energy is needed for drying, and the size of an apparatus becomes big.

In inks containing pigment, water-soluble polymers may be added to the ink in order to improve dispersion of pigment and increase the fixing strength. In particular for fixing pigments on impermeable papers, if it is desired to have enough image fastness such as rubbing resistance, more water-soluble polymers must be added. However, if the addition amount of water-soluble polymers is increased, injection may be unstable or may not be possible due to ink thickening or solidifying in the nozzles.

A method is proposed to form a liquid receptive particle layer on an intermediate transfer body, form a pattern on the surface of the liquid receptive particle layer by a liquid droplet injecting device, and transfer the patter on a recording medium.

In such configuration, regardless of difference in recording medium, it is free from oozing or image disturbance on non-permeable paper due to undried liquid droplets, excellent in pattern fastness, and enables high speed recording.

However, the liquid receptive particle layer is formed on the intermediate transfer body uniformly in an area not forming pattern or in an area not transferring on the transfer object. As a result, many liquid receptive particles are wasted.

SUMMARY

A first aspect of the invention is a pattern forming method comprising forming a liquid receptive particle layer on an intermediate transfer body within a specified area by using liquid receptive particles capable of receiving a recording liquid containing a recording material; applying a liquid droplet of the recording liquid onto a specified position of liquid receptive particle layer according to specified data, trapping the recording material near the surface of the liquid receptive particle layer on the intermediate transfer body, and forming a pattern of the recording material near the surface of the liquid receptive particle layer; and removing the liquid receptive particle layer provided with the recording liquid from the intermediate transfer body and transferring the liquid receptive particle layer with the recording liquid to a transfer object so that the pattern is positioned between the transfer object and the liquid receptive particle layer.

BRIEF DESCRIPTION OF THE DRAWINGS

Exemplary embodiments of the present invention will be described in detail based on the following figures, wherein:

FIG. 18A and FIG. 18B show a third modified example of image forming apparatus in the first embodiment of the invention, in which FIG. 18A shows ink receptive particles carried on a particle supply roll, and FIG. 18B shows ink receptive particles not carried on a particle supply roll;

FIG. 21A and FIG. 21B show a fourth modified example of image forming apparatus in the first embodiment of the invention, in which FIG. 21A shows ink receptive particles carried on a particle supply roll, and FIG. 21B shows ink receptive particles not carried on a particle supply roll.

DESCRIPTION

A pattern forming apparatus in a first exemplary embodiment of the present invention is described.

<Entire Apparatus>

An entire apparatus is first explained.

Figure 1:
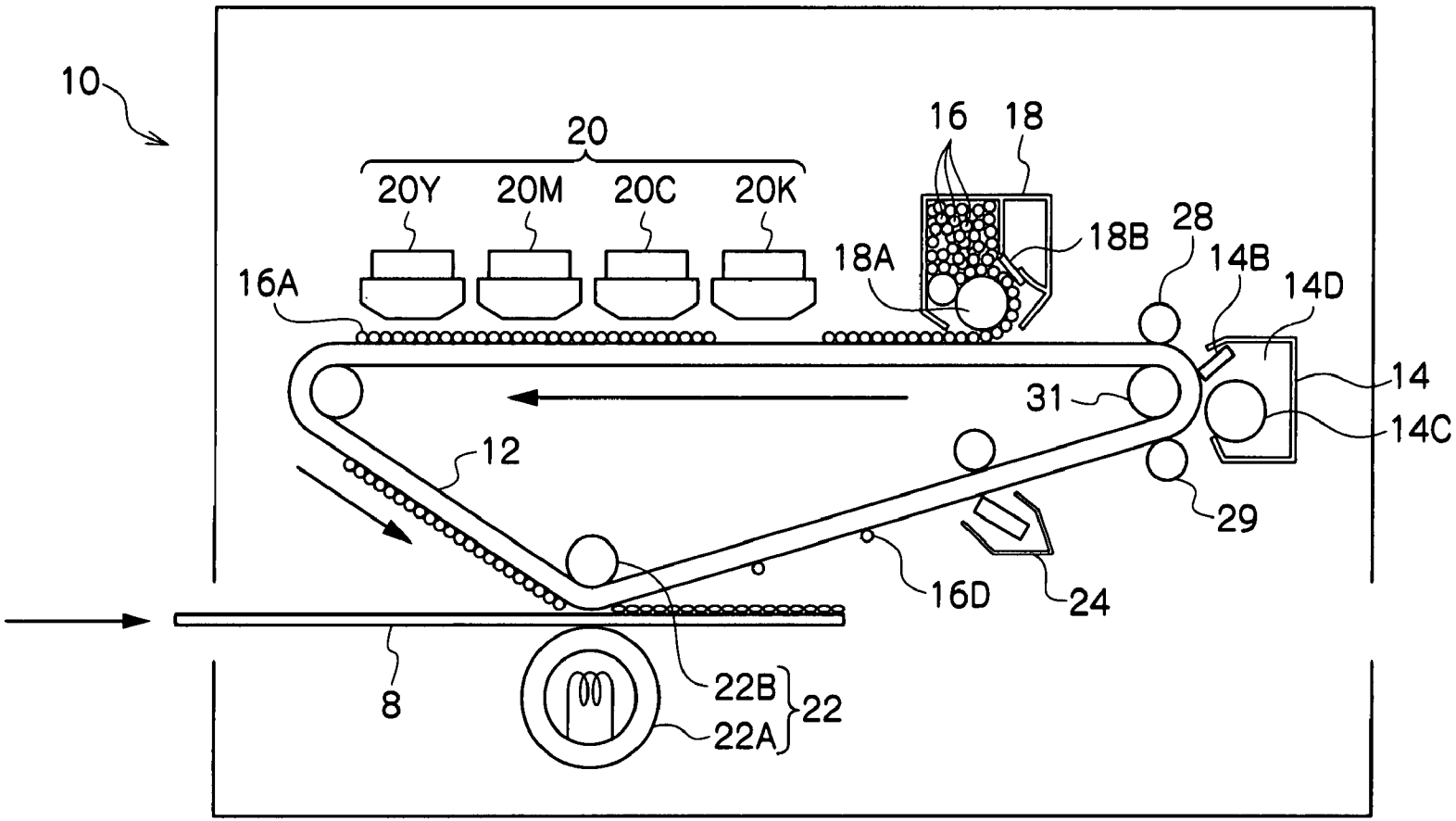
FIG. 1 is a diagram showing a pattern forming apparatus in a first embodiment of the invention.

As shown in FIG. 1, a pattern forming apparatus 10 according to an aspect of the invention comprises an intermediate transfer body 12 of endless belt, a charging device 28 for charging the surface of the intermediate transfer body 12, a particle applying device 18 for forming an ink receptive particle layer 16A by uniformly applying ink receptive particles 16 in a charged region on the intermediate transfer body 12 in a specific thickness, an ink jet recording head 20 for injecting ink droplets on the particle layer and forming an image, and a transfer fixing device 22 for overlaying a recording medium 8 on the intermediate transfer body 12, applying heat and pressure, and transferring and fixing the ink receptive particle layer on the recording medium 8.

At an upstream side of charging device 28, a releasing agent applying device 14 is disposed for forming a releasing layer 14A for promoting releasing of an ink receptive particle layer 16A from the surface of intermediate transfer body 12, in order to enhance transfer efficiency of ink receptive particle layer 16A onto the recording medium 8 from the surface of intermediate transfer body 12.

Figures 2A, 2B:
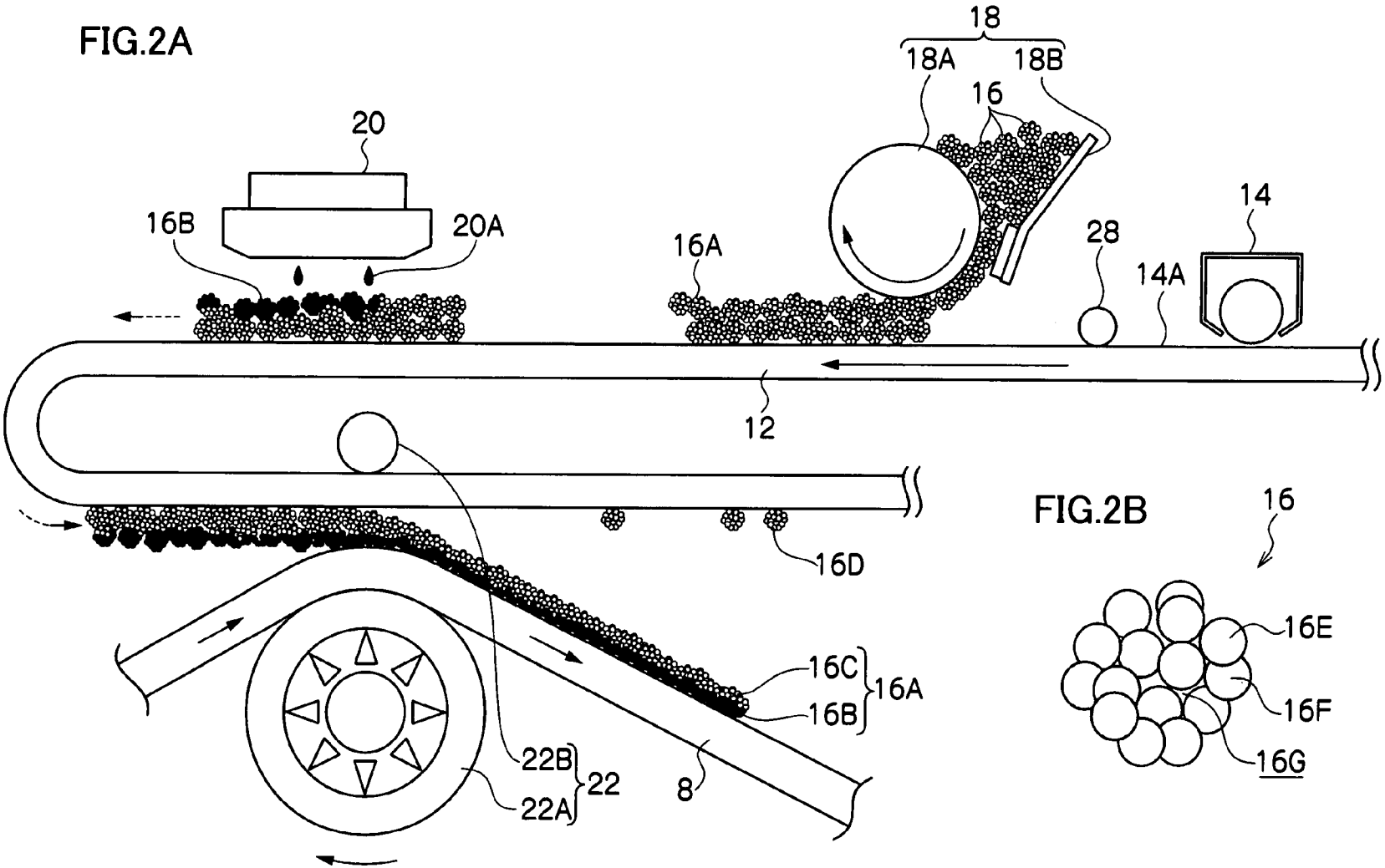
FIG. 2A is a diagram showing essential parts of image forming apparatus in the first embodiment of the invention.
FIG. 2B is a schematic diagram of ink receptive particles.

An electric charge is formed on the surface of intermediate transfer body 12 by the charging device 28, and on the charged surface of the intermediate transfer body 12, ink receptive particles 16 are applied and adhered uniformly in a specified thickness by the particle applying device 18, and an ink receptive particle layer 16A is formed. On the ink receptive particle layer 16A, as shown in FIG. 2A, ink droplets 20A in each color are ejected from ink jet recording heads 20 of individual colors, that is, 20K, 20C, 20M, 20Y, and a color image is formed.

The ink receptive particle layer 16A on which the color image is formed is transferred onto the recording medium 8 together with the color image by the transfer fixing device 22. At a downstream side of the transfer fixing device 22, a cleaning device 24 is disposed for removing ink receptive particles 16 remained on the surface of intermediate transfer body 12, and foreign matter (paper dust of recording medium 8 or the like) other than particles.

The recording medium 8 on which the color image is transferred is directly conveyed out, and the surface of the intermediate transfer body 12 is charged again by charging device 28. At this time, because the ink receptive particles 16 transferred onto the recording medium 8 absorb and hold the ink droplets 20A, the recording medium 8 can be discharged quickly, and the productivity of the apparatus as a whole can be enhanced as compared with the conventional method of absorbing ink in the recording medium 8.

In the pattern forming apparatus, as required, a neutralization device 29 may be installed between the cleaning device 24 and the releasing agent applying device 14 in order to remove the residual electric charge on the surface of the intermediate transfer body 12.

Figure 11:
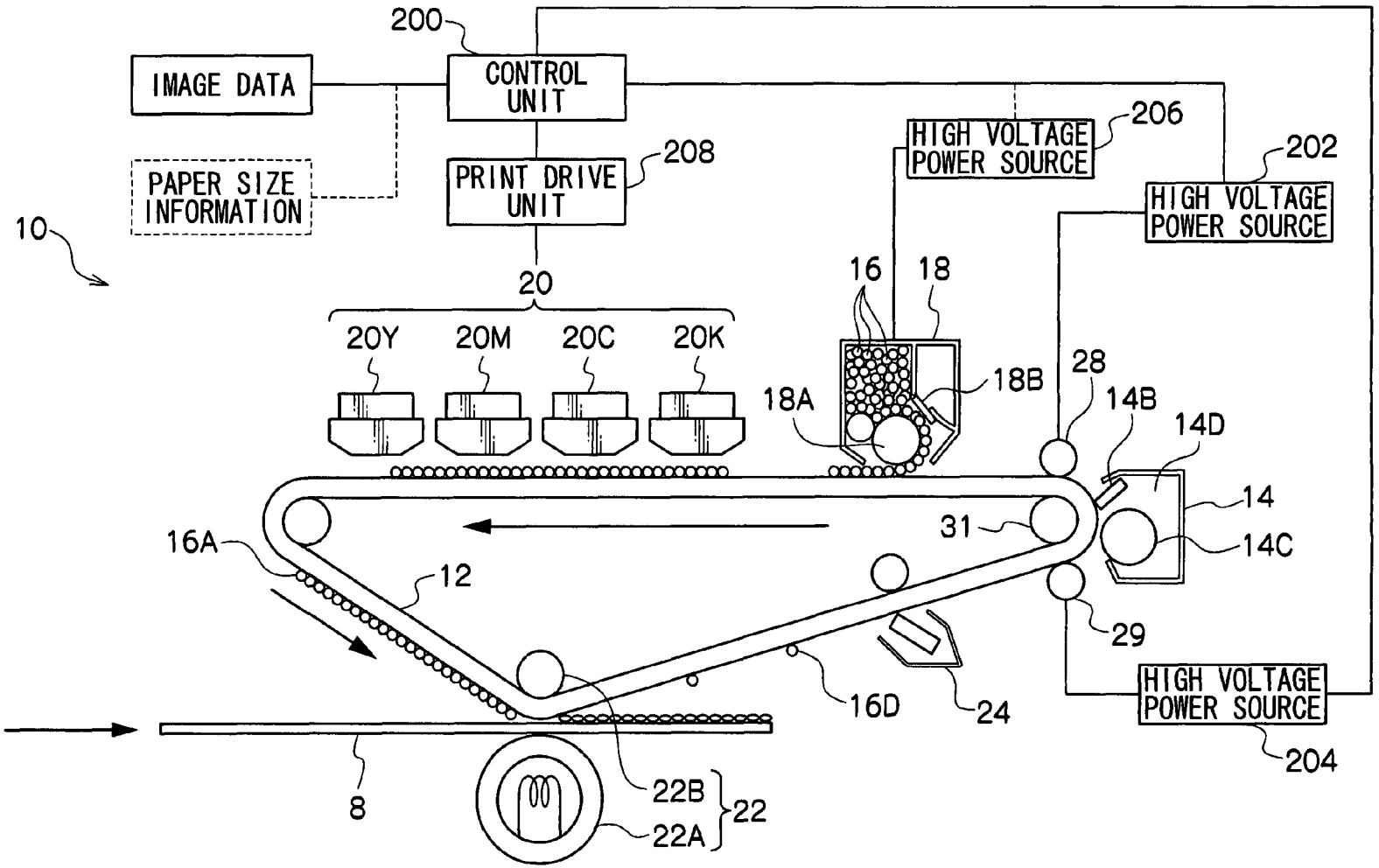
FIG. 11 is a block diagram of the pattern forming apparatus according to the first embodiment.

As shown in FIG. 11, the pattern forming apparatus 10 includes a control unit 200 for controlling the entire apparatus. The charging device 28 and neutralizing device 29 receive a high voltage respectively from a high voltage power source 202 and a high voltage power source 204. The particle applying roll 18A of the particle applying device 18 receives a high voltage from a high voltage power source 206. The ink jet recording head 20 injects ink droplets 20A (see FIG. 2) by means of a print derive unit 208.

Image information, recording medium size (paper size) and other information are entered in the control unit 200. On the basis of such information, the control unit 200 controls the high voltage power sources 202, 206 and print drive unit 208, and controls the forming area of ink receptive particle layer 16A, the timing of injecting ink droplets 20A (see FIG. 2) from the ink jet recording head 20, and others.

In the pattern forming apparatus of the present embodiment, the intermediate transfer body 12 is composed of a base layer of polyimide film of 1 mm in thickness, on which a surface layer of ethylene propylene diene monomer (EPDM) rubber of 400 μm in thickness is formed. Herein, the surface resistivity is preferably approximately 10E13 ohms/square, and the volume resistivity is approximately 10E12 ohms-cm (semi-conductivity).

Figure 3A:
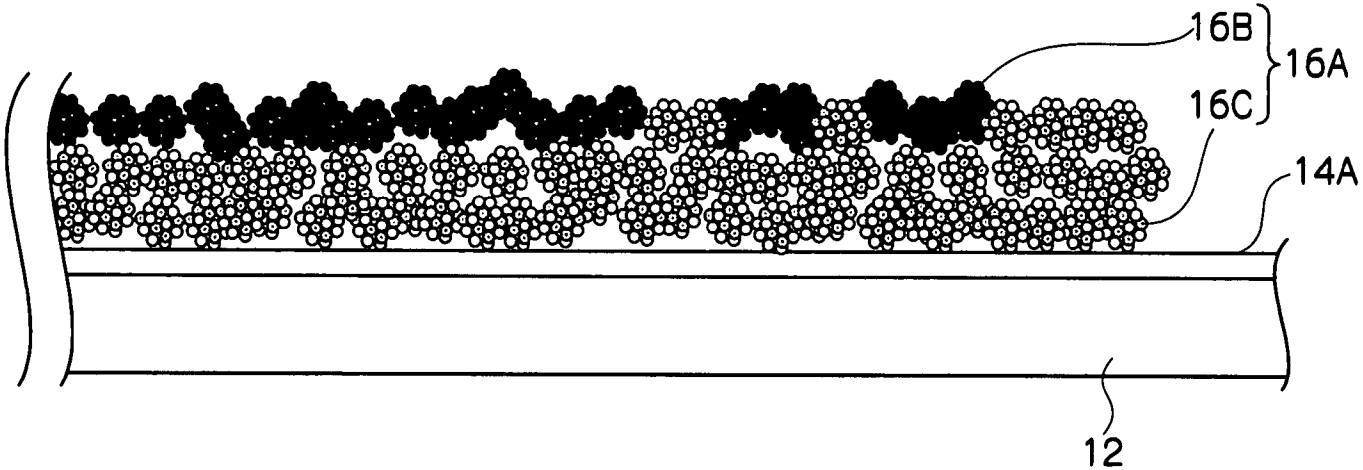
FIG. 3A shows an ink receptive particle layer on an intermediate transfer body.

The intermediate transfer body 12 is moved to convey, and a releasing layer 14A is formed on the intermediate transfer body 12 by the releasing agent applying device 14 (see FIG. 3A). A releasing agent 14D is applied on the surface of the intermediate transfer body 12 by an application roller 14C of the releasing agent applying device 14, and the layer thickness is regulated by the blade 14B (see FIG. 1).

At this time, in order to form and print images continuously, the releasing agent applying device 14 may be formed to continuously contact with the intermediate transfer body 12, or may be appropriately separated from the intermediate transfer body 12.

From an independent liquid supply system (not shown), a releasing agent 14D may be supplied into the releasing agent applying device 14, so that the supply of releasing agent 14D is not interrupted. In this embodiment, amino silicone oil is used as releasing agent 14D.

Next, by the charging device 28, a positive charge is applied onto the surface of intermediate transfer body 12. A potential capable of supplying and adsorbing ink receptive particles 16 onto the surface of intermediate transfer body 12 may be formed by an electrostatic force of electric field which can be formed between the particle supply roll 18A of particle applying device 18 and the surface of intermediate transfer body 12.

In the embodiments of the invention, using the charging device 28, a voltage is applied between the charging device 28 and a driven roll 31 (connected to ground), between which the intermediate transfer body 12 is disposed, and the surface of the intermediate transfer body 12 is charged.

The charging device 28 is a roll shaped member adjusted to have a volume resistivity of 10E6 to 10E8 ohms-cm. The charging device 28 is made of stainless steel bar material on which an elastic layer (foamed urethane resin) is formed with having a conductive material dispersed on the outer circumference. The surface of elastic layer is coated with a skin layer (PFA) of water-repellent and oil-repellent property of approximately 5 to 100 μm in thickness. It is hence effective in suppressing characteristic changes (changes in resistance value) due to humidity changes in the apparatus, or sticking of releasing agent to the charged layer surface.

A high-voltage power source 202 is connected to the charging device 28, and the driven roll 31 is electrically connected to the frame ground. The charging device 28 is driven together with the driven roll 31, while the intermediate transfer body 12 is disposed between the charging device 28 and the driven roll 31. Since, at pressing position, a specified potential difference occurs against the grounded driven roll 31, an electric charge can be applied onto the surface of the intermediate transfer body 12. Here, a DC voltage of 1 kV (constant voltage control) is applied onto the surface of intermediate transfer body 12 by the charging device 28, and the surface of the intermediate transfer body 12 is charged. AC voltage may be superimposed on the DC voltage.

The charging device 28 may be composed of a corona discharger or a brush. In this case, the voltage is applied under almost the same conditions as above. In particular, the corona discharger can apply an electric charge to the intermediate transfer body 12 without making contact.

At this time, the control unit 200 controls the high voltage power source 202, and controls to charge the intermediate transfer body 12 in a specified area in sub-scanning direction (rotating direction of intermediate transfer body 12, conveying direction of recording medium 8). The operation is specifically described below.

Figure 12A:
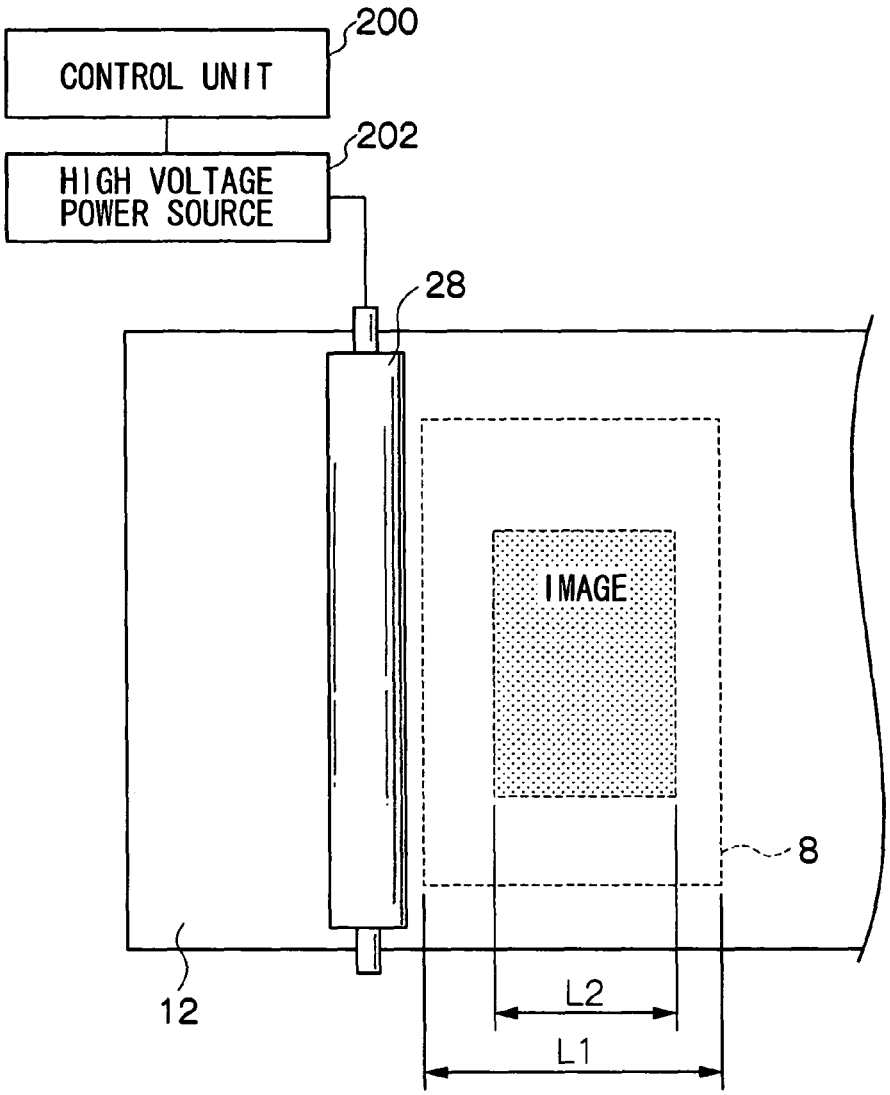
FIG. 12A is an explanatory diagram of paper area L1 and image area L2.
Figure 12B:
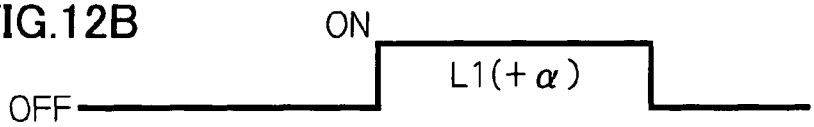
FIG. 12B is an explanatory diagram of on/off control of high voltage power source applied to a charging device in relation to the paper area.

As shown in FIG. 12A and FIG. 12B, in the rotating direction of intermediate transfer body 12, the high voltage power source 202 is turned on and off in an area corresponding to paper area L1, and only the specified area of intermediate transfer body 12 is charged. In the next process, the ink receptive particle layer 16A is formed only in the charged area corresponding to the paper area L1.

Figure 12C:
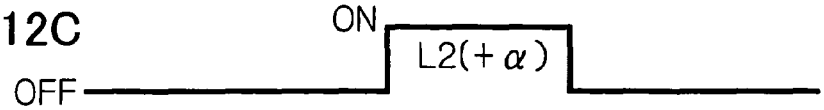
FIG. 12C is an explanatory diagram of on/off control of high voltage power source applied to a charging device in relation to the image area.

Or as shown in FIG. 12A and FIG. 12C, alternatively in the rotating direction of intermediate transfer body 12, the high voltage power source 202 is turned on and off in an area corresponding to image forming area, and only the specified area of intermediate transfer body 12 is charged, and the ink receptive particle layer 16A is formed.

As a result, the ink receptive particles 16A are not formed in the area not transferred on the recording medium 8, or the area not forming an image, and waste of ink receptive particles 16 is avoided substantially, and the running cost is lowered significantly.

Actually, considering some difference with respect to the charged area dimension, the charging area may be increased somewhat.

Next, as shown in FIG. 1 and FIG. 11, ink receptive particles 16 are supplied from the particle applying device 18 onto the surface of intermediate transfer body 12, and an ink receptive particle layer 16A is formed in the paper area L1, or image area L2 (see FIG. 12). The particle applying device 18 has a particle supply roll 18A at a portion of a container of ink receptive particles 16. The particle supply roll 18A is disposed opposite to the intermediate transfer body 12, and a charging blade 18B is equipped so as to press against the particle supply roll 18A. The charging blade 18B also functions of charging the ink receptive particles 16 and defining the layer thickness of ink receptive particles 16 applied on the surface of particle supply roll 18A.

Ink receptive particles 16 may be composed as follows.

(Ink Receptive Particles A-1)

100 parts of Styrene/n butyl methacrylate/acrylic acid copolymer particles (volume average particle diameter 0.2 μm, acid value=240, partially neutralized with a sodium hydroxide, Tg=approximately 60 deg. C.), 30 parts of Amorphous silica particles (1:1 mixture of Aerosil OX50, (trade name, manufactured by Nippon Aerosil Co., Ltd., volume average particle diameter=approximately 40 nm) and Aerosil TT600 (trade name, manufactured by Nippon Aerosil Co., Ltd., volume average particle diameter=40 nm))

These particles are mixed, and a trace of sterilizer aqueous solution (Proxel GXL(S), trade name, manufactured by Arch Chemicals Japan) are added, stirred and mixed (approximately 30 seconds by sample mill), then processed intermittently by mechano-fusion system, and made into composite particles. Particle size is measured at every intermittent driving state, and particles are taken out at the stage of approximately 5 μm. By granulating in this manner, aggregated composite particles (base particles a1) of average equivalent spherical diameter of 5 μm are manufactured.

To these aggregated composite particles (base particles a1), 1.0 mass % of hydrophobic surface-treated silica particles (Aerosil R972, trade name, manufactured by Nippon Aerosil Co., Ltd., volume average particle diameter=approximately 16 nm) and 0.5 mass % of untreated hydrophilic silica particles (Aerosil 130, trade name, manufactured by Japan Aerosil Co., Ltd., volume average particle diameter=approximately 16 nm) are added externally, and particles A-1 are prepared. The resulting particles A-1 are used as ink receptive particles 16.

Ink receptive particles 16 are supplied to the particle supply roll 18A (conductive roll), and the ink receptive particle layer 16A is regulated by the charging blade 18B, and is charged negatively with the reverse polarity of the electric charge on the surface of the intermediate transfer body 12. The supply roll 18A may be an aluminum solid roll, and the charging blade 18B may be made of a metal plate (such as SUS, or the like) being coated with urethane rubber or the like in order to apply pressure. The charging blade 18B is contacting with the supply roll 18A in a type of doctor blade.

The charged ink receptive particles 16 form, for example, approximately one layer of particles on the surface of the particle supply roll 18A, and are conveyed to a position opposite to the surface of intermediate transfer body 12. When closing to the intermediate transfer body 12, the charged ink receptive particles 16 are moved onto the surface of intermediate transfer body 12 electrostatically by an electric field that is formed by the potential difference on the surfaces of the particle supply roll 18A and the intermediate transfer body 12

At this time, a relative ratio (peripheral speed ratio) of moving speed of intermediate transfer body 12 and rotating speed of supply roll 18A is determined such that approximately one layer of particles is formed on the surface of intermediate transfer body 12. This peripheral speed ratio depends on the charging amount of intermediate transfer body 12, charging amount of ink receptive particles 16, relative positions of supply roll 18A and intermediate transfer body 12, and other parameters.

On the basis of the peripheral speed ratio for forming approximately one layer of the ink receptive particle layer 16A, if the peripheral speed of particle supply roll 18A is relatively accelerated, the number of particles supplied on the intermediate transfer body 12 may be increased. It is hence possible to control the layer thickness of ink receptive particle layer 16A formed on the intermediate transfer body 12. That is, when the transferred image density is low (an amount of the ink loaded is small), the thickness of the ink receptive particle layer 16A is regulated to a minimally required limit, and when the image density is high (an amount of the ink loaded is large), it is preferred to regulate the peripheral speed of the particle supply roll 18A so as to form a sufficient layer thickness for holding the ink solvent.

For example, in the case of a character image at which an amount of ink loaded is small, an approximately one layer of the ink receptive particle layer is formed on the intermediate transfer body. The image forming material (pigment) in the ink is trapped near the surface of ink receptive particle layer 16A on the intermediate transfer body 12. The image forming material (pigment) is fixed on the surface of porous particles or fixing particles that are forming the ink receptive particles 16, so that the distribution of the image forming material (pigment) is smaller in the depth direction of the layer. Accordingly, after transferring and fixing, the image forming material (pigment) which is exposed on the surface of the image is small, and sufficient fixing property against abrasion or the like is realized as compared with the case of forming an image directly on the recording material surface (the case where almost all pigment exists near the surface of the image).

For example, if it is desired to form a particle layer 16C (non-image portion) to be a protective layer on an image layer 16B that is to be a final image (see FIG. 3), the ink receptive particle layer 16A is formed at substantially three layers thick, and the ink image is formed on the uppermost layer only, so that the remaining two layers not being formed with image can be made. These two layers are formed as protective layers on the image layer 16B after transferring and fixing onto the recording medium (see FIG. 3B).

Alternatively, when forming an image in two or more colors, or an image at which an amount of ink loaded is large, ink receptive particles 16 are layered so that the number of the particles is sufficient for the solvent to be held in the ink, for the pigment to be trapped on the surface of porous particles and fixing particles and not to reach the lowest layer. In this case, the image forming material (pigment) is not exposed on the image layer surface after transferring and fixing to the recording medium 8, and ink receptive particles not being formed with image may be provided as protective layers on the image surface.

Next, the ink jet recording head 20 applies ink droplets 20A to the ink receptive particle layer 16A. Based on the specified image information, the ink jet recording head 20 applies ink droplets 20A to specified positions.

Finally, by nipping the recording medium 8 and intermediate transfer body 12 by the transfer fixing device 22, and applying pressure and heat to the ink receptive particle layer 16A, the ink receptive particle layer 16A is transferred onto the recording medium 8.

The transfer fixing device 22 is composed of a heating roll 22A incorporating a heating source, and a pressurizing roll 22B, between which the intermediate transfer body 12 is disposed. The heating roll 22A and pressurizing roll 22B abut against each other to form a nip. The heating roll 22A and pressurizing roll 22B are, like a fixing device (fuser) of electrophotography, formed of an aluminum core, coated with silicone rubber on the outer surface, and are further covered with a PFA tube.

In the nip of heating roll 22A and pressurizing roll 22B, the ink receptive particle layer 16A is heated by the heater and is pressurized, and hence the ink receptive particle layer 16A is transferred and fixed simultaneously onto the recording medium 8.

At this time, resin particles in non-image layer are heated above the softening point (Tg), and are softened (or fused), and the ink receptive particle layer 16A is released from the releasing layer 14A formed on the surface of intermediate transfer body 12 by the pressure, and is transferred and fixed on the recording medium 8. Since weakly liquid absorbing resin particles (fixing particles 16E) of the image portions loaded with ink are softened by absorbing the ink solvent, the ink receptive particle layer 16A is released from the releasing layer 14A formed on the surface of intermediate transfer body 12 by the pressure, and is transferred and fixed onto the recording medium 8. At this time, transfer fixing property is improved by heating. In this embodiment, the surface of heating roll 22A is controlled at 160 deg. C. At this time, the ink solvent held in the ink receptive particle layer 16A is held in the same ink receptive particle layer 16A even after transfer, and is fixed. The efficiency of transfer and fixing may be enhanced by preheating the intermediate transfer body 12.

Referring to FIG. 2, the image forming process according to the first embodiment of the invention is described below.

As shown in FIG. 2, on the surface of intermediate transfer body 12, a releasing layer 14A formed by a releasing layer applying device 14 in order to prevent problems of sticking of ink receptive particles 16 due to moisture adhesion to the surface, as well as to secure releasing property when transferring. If the material of the intermediate transfer body 12 is aluminum or PET base, releasing layer 14A provision is particularly effective. Or by using the material such as fluorine resin or silicone rubber, the surface of the intermediate transfer body 12 may be provided with releasing property.

Next, the paper region L1 or the image region L2 in the sub-scanning direction on the surface of intermediate transfer body 12 (see FIG. 12) is charged with the reverse polarity of the ink receptive particles 16 by the charging device 28. As a result, the ink receptive particles 16 supplied by the supply roll 18A of the particle applying device 18 can be adsorbed to the intermediate transfer body 12 electrostatically, and a layer of ink receptive particles 16 can be formed in the paper region L1 or the image region L2 on the surface of the intermediate transfer body 12.

Further, on the surface of the intermediate transfer body 12, ink receptive particles 16 are formed as a uniform layer by the supply roll 18A of the particle applying device 18. For example, the ink receptive particle layer 16A is formed such that a thickness thereof corresponds to substantially three layers of particles. That is, the particle layer 16A is regulated to a desired thickness by the gap between the charging blade 18B and supply roll 18A, and thus, the thickness of the particle layer 16A transferred on the recording medium 8 is regulated. Or it may be regulated by the peripheral speed ratio between the supply roll 18A and the intermediate transfer body 12.

Note that ink receptive particles 16 composed of, as shown in FIG. 2B, fixing particles 16E and porous particles 16F aggregated and granulated across gaps 16G as primary particles so that ink receptive particles 16 is formed as secondary particles. The ink receptive particles 16 are preferably secondary particles of 2 to 3 μm in diameter.

On the formed particle layer 16A, ink droplets 20A are ejected from ink jet recording heads 20 of individual colors driven by piezoelectric or thermal systems, and an image layer 16B is formed on the particle layer 16A. Ink droplets 20A ejected from the ink jet recording head 20 are loaded to the ink receptive particle layer 16A, and are promptly absorbed by gaps 16G formed within ink receptive particles 16, and the solvent is then sequentially absorbed in the pores of porous particles 16F and fixing particles 16E, and the pigment (coloring material) is trapped on the surface of primary particles (fixing particles 16E and porous particles 16F) forming the ink receptive particles 16.

At this time, gaps between primary particles forming the secondary particles function as a filter, and trap the pigment in the ink near the surface of the particle layer. By trapping and fixing the pigment on the primary particle surface, most of the pigment can be trapped near the surface of the ink receptive particle layer 16A.

In order to trap the pigment on the surface of primary particles and near the surface of ink receptive particle layer 16A with certainty, it is possible to use a method whereby the ink and ink receptive particles 16 are made to react with each other, and the pigment promptly made insoluble (to aggregate).

After trapping of pigment, the ink solvent permeates in the depth direction of the particle layer, and is absorbed in the pores of porous particles 16F and fixing particles 16E, and is held in gaps 16G between particles. The fixing particles 16E absorbing the ink solvent are softened, and hence contribute to transfer and fixing.

Accordingly, advancing to next ink jet recording head 20, when ink droplets 20A of next color are ejected, mixing of inks and bleeding phenomenon can be suppressed.

At this time, the solvent or dispersion medium contained in the ink droplets 20A permeates into the particle layer 16A, however the recording material such as pigment is trapped near the surface of the particle layer 16A. That is, the solvent or dispersion medium may permeate in the depth direction of the particle layer 16A, however, the recording medium, such as pigment, does not permeate in the depth direction of the particle layer 16A. Hence, when transferred onto the recording medium 8, the particle layer 16C (non-image portion) that is not permeated with the recording material, such as pigment, is formed to be a layer on the image layer 16B. As a result, this particle layer 16C becomes a protective layer for sealing the surface of image layer 16B. The coloring material, such as pigment, is not exposed to the surface, and an image having superior resistance to abrasion can be formed. The ink is preferred to be a pigment ink of concentration of about 10% or more, but it is not limited to pigment ink, and a dye ink may be also used.

By transferring and fixing the ink receptive particle layer 16A onto the recording medium 8 from the intermediate transfer body 12, a color image is formed on the recording medium 8. The ink receptive particle layer 16A on the intermediate transfer body 12 are heated and pressurized by the transfer fixing roll 22 heated by heating unit such as heater, and transferred onto the recording medium 8. Fixing is carried out with fixing particles 16E by adhesion between fixing particles 16E, or adhesion of fixing particles 16E and recording medium 8 by pressure and heat.

At this time, by adjusting heat and pressure as mentioned below, the roughness of the image surface can be properly adjusted, and the degree of gloss (surface glossiness, same as hereinafter) can be controlled. Similar effects can also be obtained by cooling and removing off.

After removing off the ink receptive particle layer 16A, residual particles 16D remained on the surface of intermediate transfer body 12 are collected by the cleaning device 24 indicated in FIG. 1, and the surface of intermediate transfer body 12 is charged again by the charging device 28, and the ink receptive particle layer 16A is formed.

FIG. 3 shows particle layers used in forming of images in the first embodiment of the invention.

As shown in FIG. 3A, on the surface of intermediate transfer body 12, a releasing layer 14A is formed to assure releasing property when transferring the ink receptive particle layer 16A onto the recording medium 8 and to prevent adhesion inhibition of ink receptive particles 16 due to moisture adhesion to the surface.

On the surface of intermediate transfer body 12, a uniform ink receptive particle layer 16A is formed by the particle applying device 18. The ink receptive particle layer 16A is preferred to be formed such that a thickness thereof corresponds to three layers of ink receptive particles 16. By controlling the ink receptive particle layer 16A to a desired thickness, the thickness of the ink receptive particle layer 16A transferred on the recording medium 8 is controlled. At this time, the surface of ink receptive particle layer 16A is formed in a uniform thickness so as not to disturb image forming (forming of ink image layer 16B) by ejection of ink droplets 20A.

The recording material such as pigment contained in the ejected ink droplets 20A permeates into substantially one third to half in the depth length of particle layer 16A as shown in FIG. 3A, and a particle layer 16C into which recording material such as pigment has not permeated is remained beneath part of the particle layer 16A.

Figure 3B:
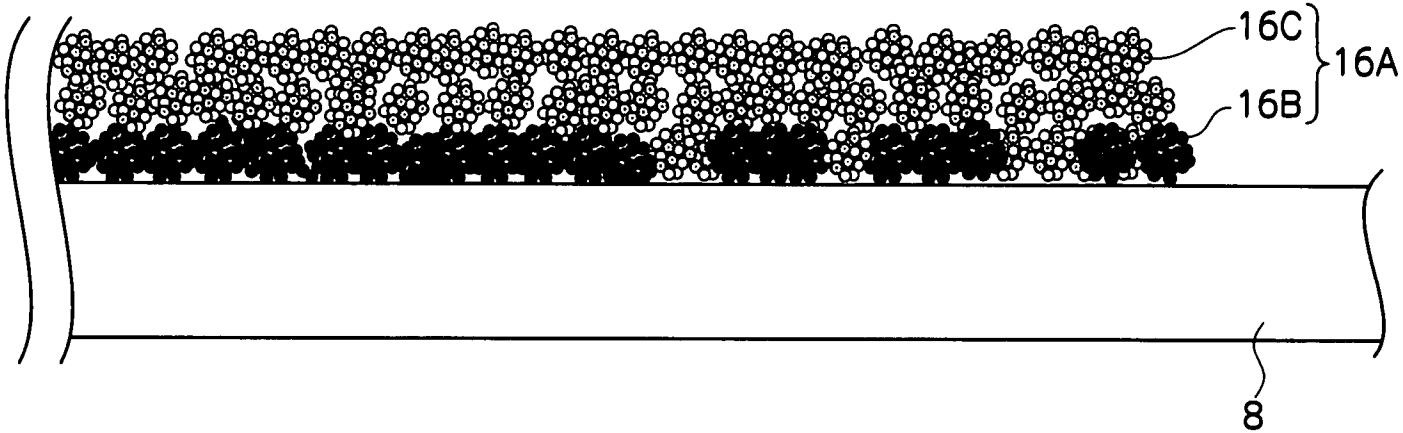
FIG. 3B is a diagram showing the ink receptive particle layer after being transferred on a recording medium.

When formed on the recording medium 8 by heating, pressing and transferring using the transfer fixing roll 22, as shown in FIG. 3B, a particle layer 16C not containing recording material such as pigment remains on the ink image layer 16B, and this layer functions as a protective layer for the ink image layer 16B, so the ink image layer 16B does not directly appear on the surface of the image. Accordingly, the ink receptive particles 16, at least after fixing must be transparent.

The particle layer 16A is heated and pressurized by the transfer fixing roll 22, and its surface can be made sufficiently smooth, and the degree of gloss of the image surface can be controlled by heating and pressing. That is, by controlling either the pressure or heat (or both) applied during transfer and fixing, it is possible to change the state of the surface of the ink receptive particle layer 16A transferred and fixed on the recording medium 8. By increasing the pressure or heat, the roughness of surface of ink receptive particle layer 16A is decreased, and the gloss is improved. By decreasing the pressure or heat, the surface of ink receptive particle layer 16A is not smoothed (remains rough), thereby the gloss is not improved while a matte finish is obtained.

Further, drying of solvent trapped inside the ink receptive particles 16 may be promoted by heating.

The ink solvent received and held in the ink receptive particle layer 16A is also held in the ink receptive particle layer 16A after transferring and fixing, and is removed by natural drying, in the same way as drying of ink solvent in ordinary water-based ink jet recording. Accordingly, regardless of difference in ink permeability of recording medium 8, or even on an impermeable paper, an image of high quality can be formed at higher speed than a case an image is formed by using water-based ink.

Through the above process, the image forming is completed. If residual particles 16D or foreign matter such as paper dust removed from the recording medium 8 are remained on the intermediate transfer body 12, after transfer of ink receptive particles 16 on the recording medium 8, they may be removed by the cleaning device 24.

When charging is repeated on the intermediate transfer body 12, the charging amount may not remain constant. In such a case, a neutralization apparatus 29 may be disposed at the downstream side of the cleaning device 24. Using a similar conductive roll as in the charging device 28 and nipping with the driven roll 30 (grounded), an alternating-current voltage of approximately ±3 kV, 500 Hz is applied to the surface of intermediate transfer body 12, and the surface of intermediate transfer body 12 can be neutralized.

The charging voltage, particle layer thickness, fixing temperature and other mechanical conditions are determined in optimum conditions depending on the composition of ink receptive particles 16 or ink, ink ejection volume, and the like, and hence desired effects can be obtained by optimizing each condition.

In the present embodiment, by on/off control of the charging device 28, the ink receptive particle layer 16A is formed only in a specified area in sub-scanning direction, but the invention is not limited to this example alone.

For example, by controlling the high voltage power source 206 (see FIG. 11) of the particle applying device 18, the area of sub-scanning direction for forming the ink receptive particle layer 16A (the paper area L1 or image area L2 shown in FIG. 12) may be controlled. That is, the high voltage applied to the particle supply roll 18A is set at same potential as the intermediate transfer body 12 except when supplying particles 16 in specified area in sub-scanning direction, so that the ink receptive particle layer 16A can be formed only in the specified area in sub-scanning direction (the paper area L1 or image area L2 shown in FIG. 12).

Or by controlling the rotation of the particle supply roll 18A (controlling to rotate and to stop rotation), the area of sub-scanning direction for forming the ink receptive particle layer 16A (the paper area L1 or image area L2 shown in FIG. 12) may be controlled. That is, the rotation of the particle supply roll 18A is stopped except when supplying particles 16 in specified area in sub-scanning direction, so that the ink receptive particle layer 16A can be formed only in the specified area in sub-scanning direction (the paper area L1 or image area L2 shown in FIG. 12).

Modified examples of the embodiment are explained.

As mentioned above, the area of forming the ink receptive particle layer 16A on the intermediate transfer body 12 can be controlled only in the sub-scanning direction. By contrast, in the following modified examples, the area of forming the ink receptive particle layer 16A on the intermediate transfer body 12 can be controlled also in the main scanning direction (direction orthogonal to rotating direction of intermediate transfer body 12, direction orthogonal to conveying direction of recording medium 8).

A first modified example is shown.

Figure 13:
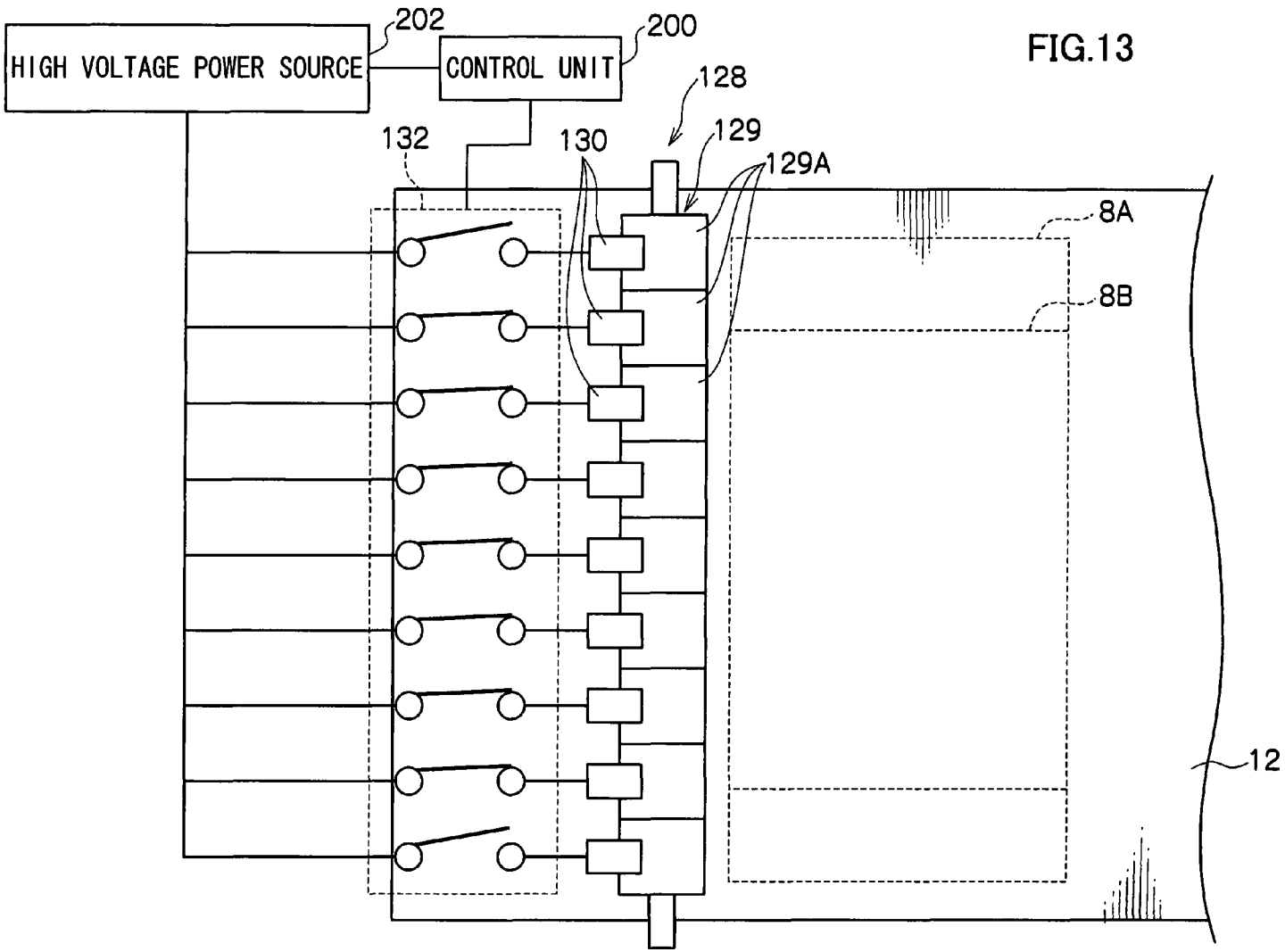
FIG. 13 is a diagram of a first modified example of image forming apparatus in the first embodiment of the invention.

As shown in FIG. 13, the charging device 128 has a charging roll 129. The charging roll 129 has a plurality of small rolls 129A arranged in main scanning direction, and small rolls 129A are insulated from each other. On the surface of each small roll 129A, each brush electrode 130 contacts. Each brush electrode 130 is connected to the high voltage power source 202 by way of a switching unit 132. Hence a high voltage can be applied in the unit of small roll 129A, and the charging area of intermediate transfer body 12 can be controlled. That is, in the intermediate transfer body 12, only the specified area is charged, not only in the sub-scanning direction but also in the main scanning direction, and the ink receptive particle layer 16A can be formed.

For example, as shown in FIG. 13, in the case of a wide recording medium 8A, the switching unit 132 is controlled, and a high voltage is applied to all small rolls 129A to charge. By contrast, in the case of a narrow recording medium 8B, the switching unit 132 is controlled, and a high voltage is not applied to some of outside small rolls 129A, and only the area corresponding to the width of recording medium 8B is charged. In FIG. 13, corresponding to the narrow recording medium 8B, high voltage is not applied to one small roll 129A each at both outer sides.

As explained in the first embodiment, further, by on/off control of charging, the charging area in the sub-scanning direction can be also controlled, and the intermediate transfer body 12 can be charged in the same area as the recording medium 8, and the ink receptive particle layer 16A can be formed.

Figure 14A:
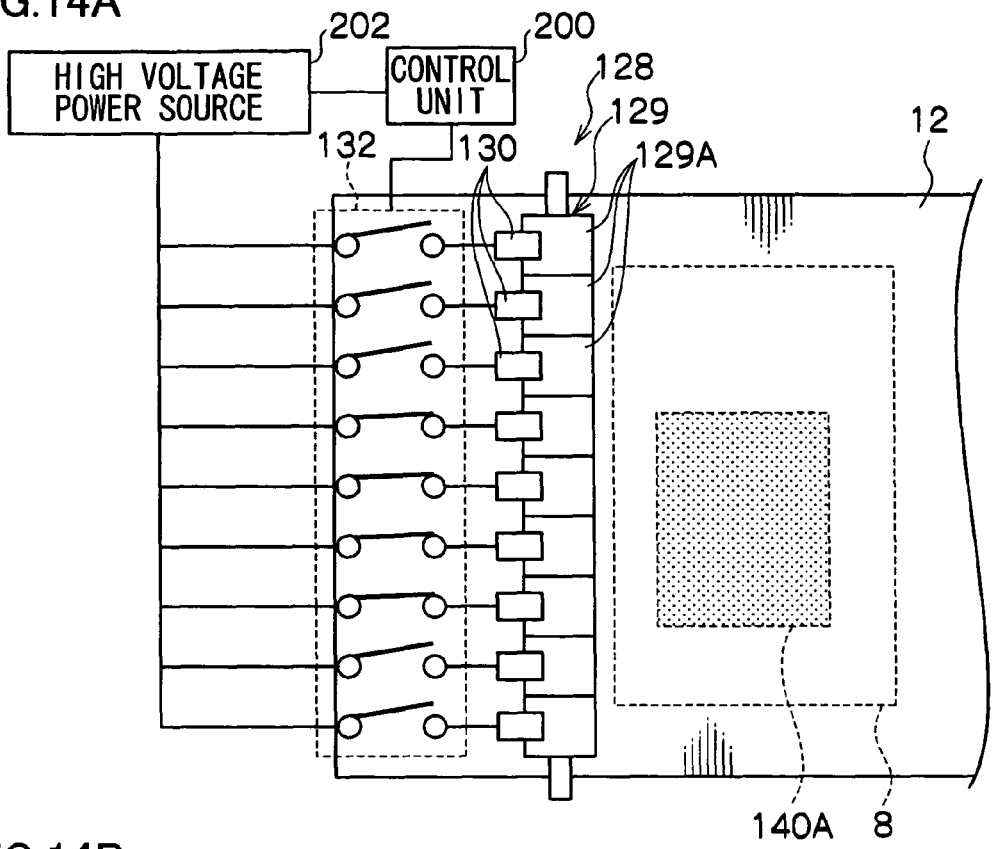
FIG. 14A is an explanatory diagram of an example of charging only the image area in the first modified example.

Instead of the paper size of the recording medium 8, depending on the image area 140A, as shown in FIG. 14A, the switching unit 132 can be controlled, and voltage is not applied to some of outside small rolls 129A, and the intermediate transfer body 12 is charged only in the area corresponding to the image width. In the diagram, voltage is not applied to two small rolls 129A each at both outer sides.

Figure 14B:
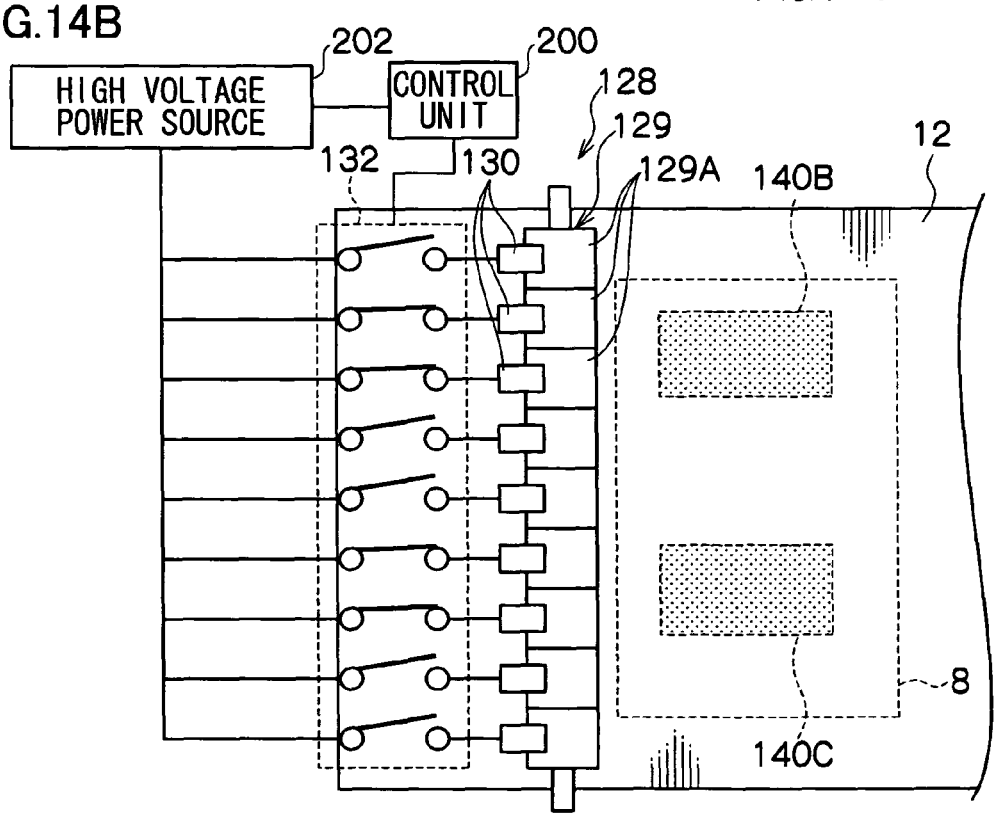
FIG. 14B is an explanatory diagram of an example of the image area divided into a plurality of section.

Further, as shown in FIG. 14B, when the image area is divided into image area 140B and image area 140C, it may be designed to charge without applying voltage to some of the central small rolls 129A. In the diagram, the switching unit 132 is in the state of, from the top of the diagram, off-on-off (portion corresponding to image area 140B)-off-off-on-on (portion corresponding to image area 140C)-off-off.

Note that this control method corresponding to the image area requires a certain process for determining the area from the image data. By contrast, the width of recording medium 8 is determined easily from the paper size information (user's selection, or automatic judging). Besides, division control in the main scanning direction may be sufficient by a minimum limit division based on classification of paper size types that can be conveyed by the apparatus. It is less costly to control the charging area on the basis of the size (paper size) of recording medium 8.

The main scanning direction is divided effectively in every 5 to 10 mm when corresponding to the image data, or may be divided in every 20 to 30 mm when corresponding to the paper size.

Figure 15:
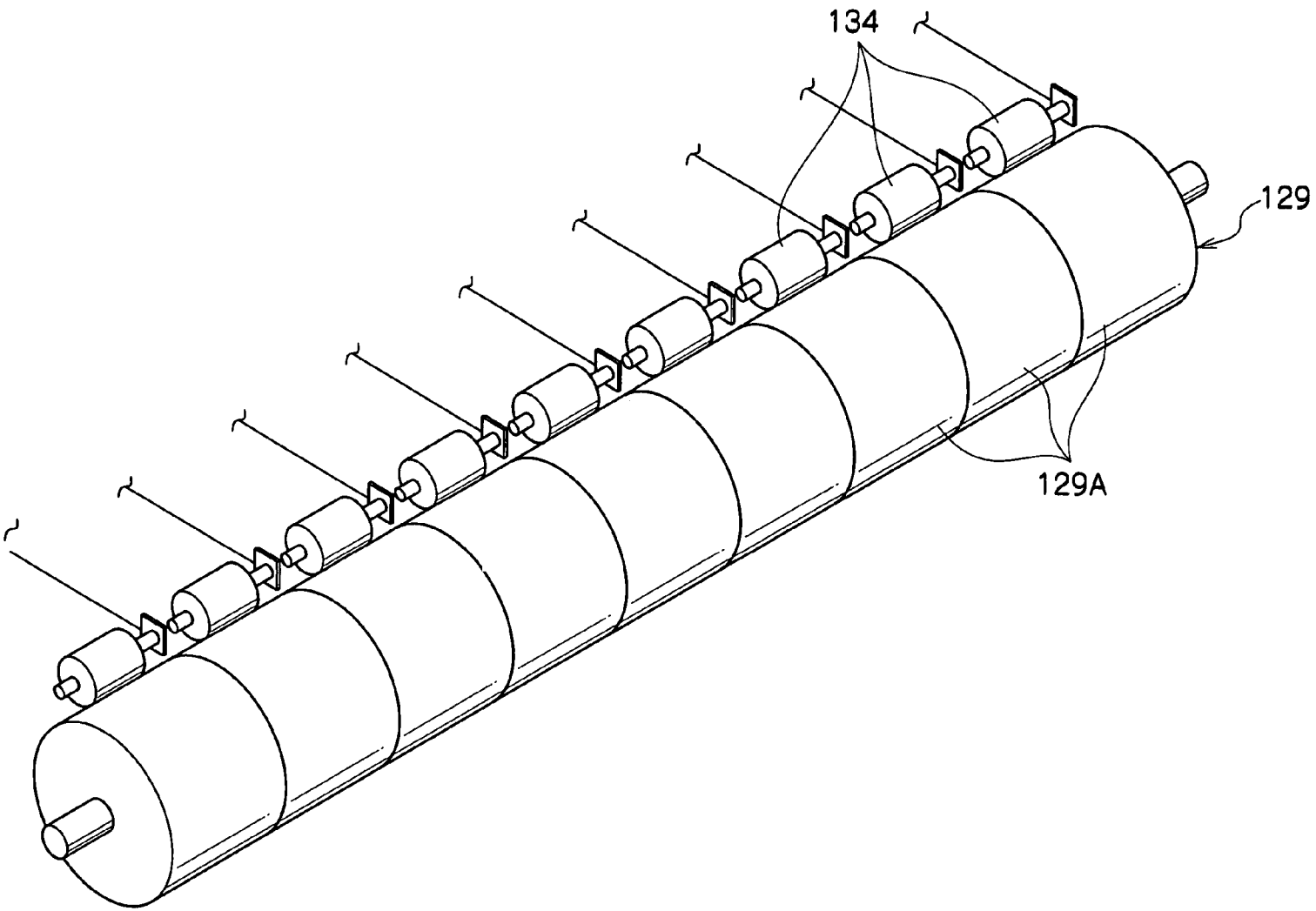
FIG. 15 is a diagram showing other example of the first modified example.

On the surface of each small roll 129A, instead of the brush electrode 130, a roll electrode 134 may contact as shown in FIG. 15 to apply a high voltage. Such roll electrode 134 is preferred because the damage on the surface of small roll 129A (charge roll 129) is suppressed.

Figure 16:
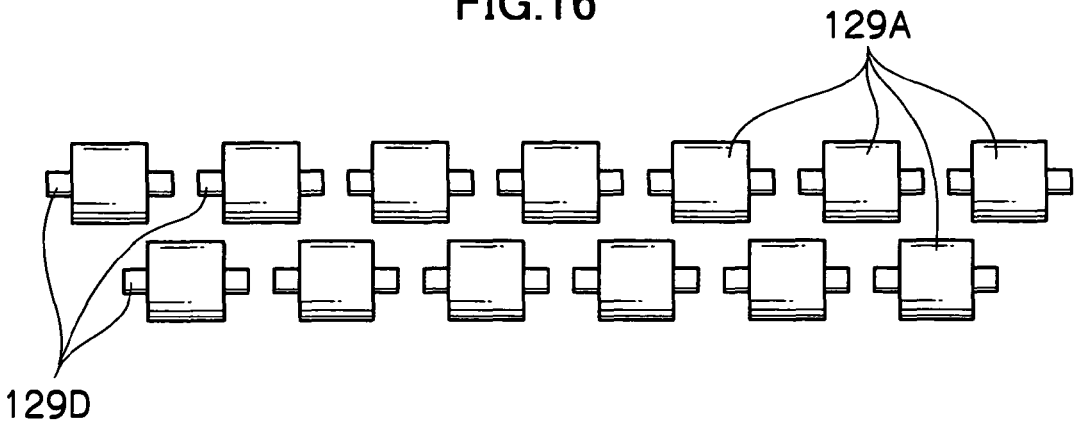
FIG. 16 is a diagram showing another example of the first modified example.

The small rolls 129A are formed in a row, but may be arranged also in zigzag form as shown in FIG. 16. In such configuration, a high voltage may be applied from each rotary shaft 129D of small roll 129A.

A second modified example is explained.

Figure 17:
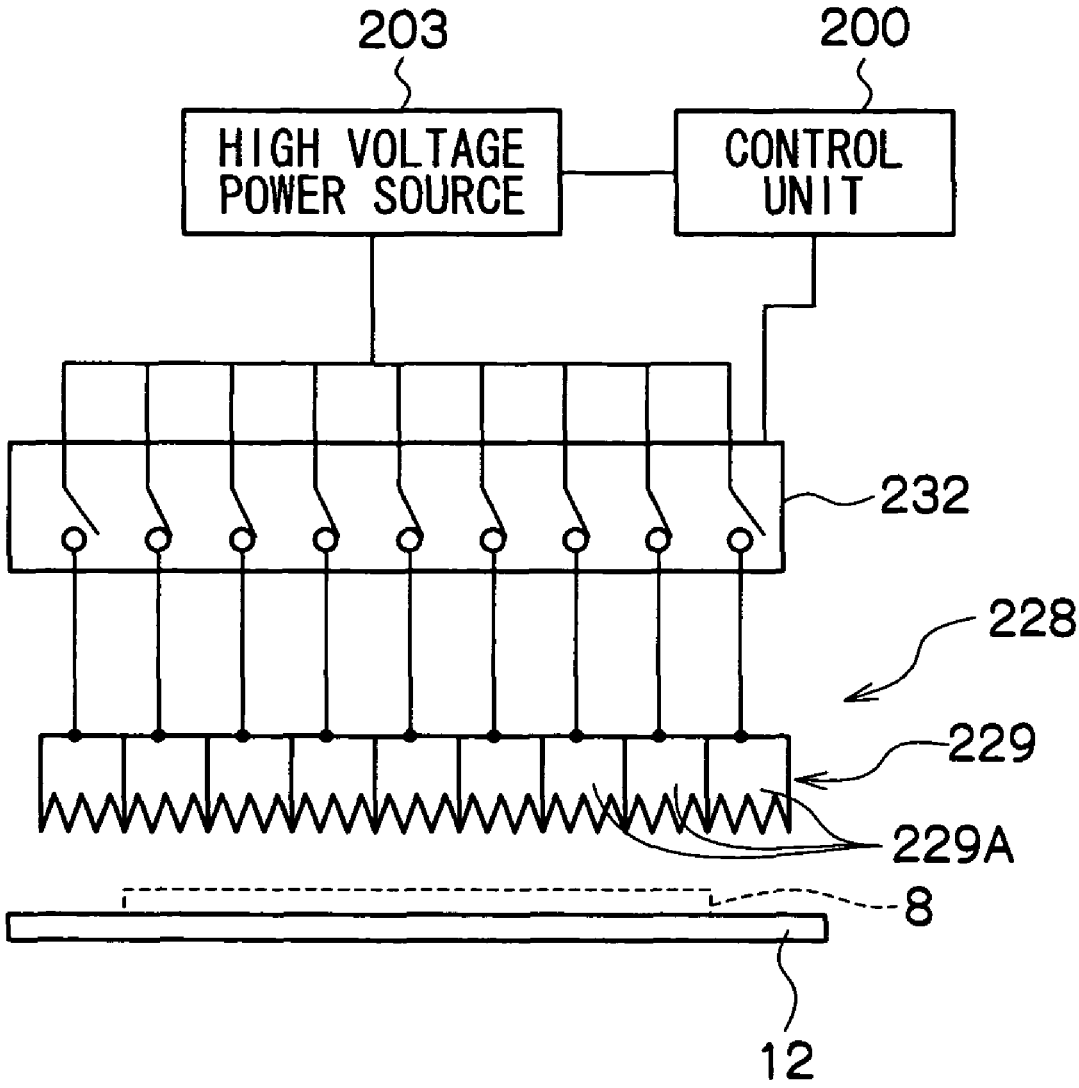
FIG. 17 is a diagram of a second modified example of image forming apparatus in the first embodiment of the invention.
Figure 18A:
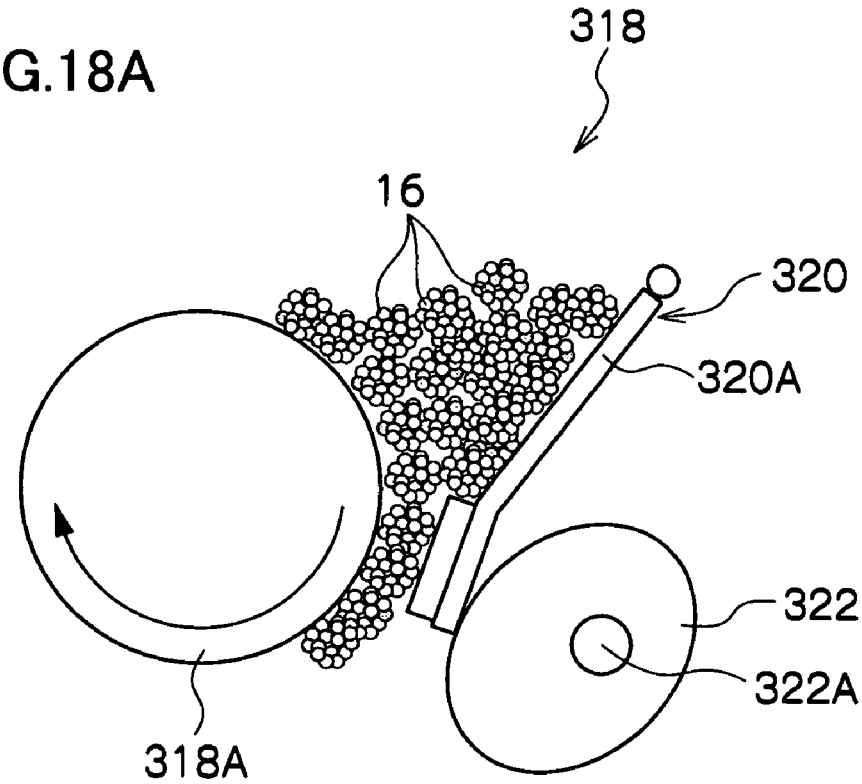
Figure 18B:
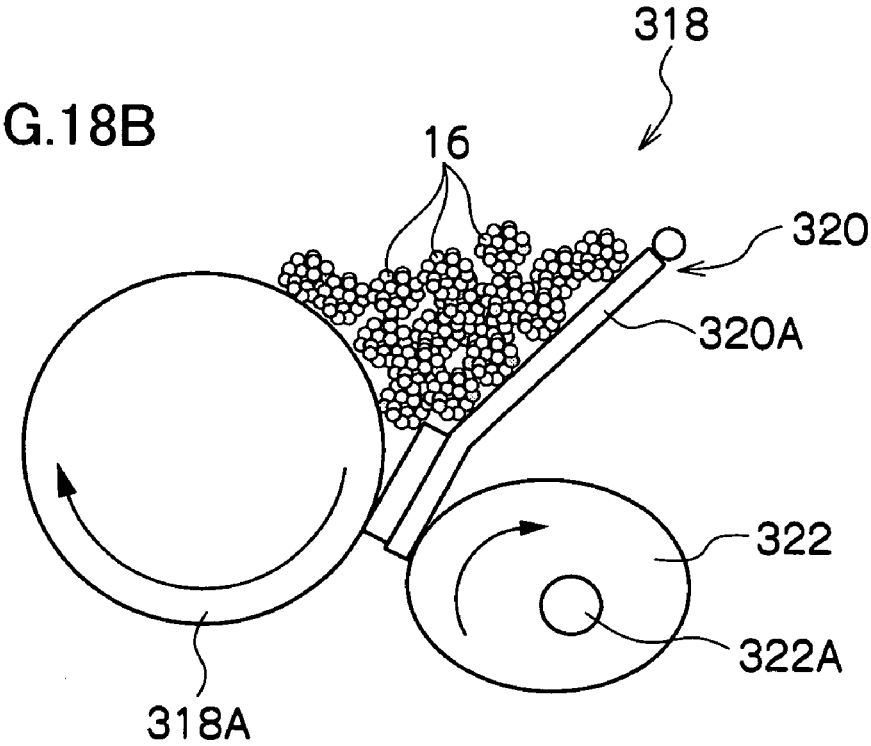

As shown in FIG. 17, a charging device 228 has a plurality of needle electrodes 229 with pointed ends and sawtooth profile. The needle electrodes 229 are disposed at the discharge side of stainless steel or other conductive thin plate (thickness about 0.1 to 1 mm), and a plurality of needle protrusions (1 to 5 mm pitch) are disposed at a distance of about 0.5 to 5 mm from the charging side (surface of intermediate transfer body 12), and a voltage is applied to protrusions to discharge, and the intermediate transfer body 12 is charged. The needle electrodes 229 have a plurality of electrode parts 229A arranged in the main scanning direction, and the electrode parts 229A are insulated from each other. Each electrode part 229A is connected to the high voltage power source 203 by way of a switching unit 232. Hence a high voltage can be applied in the unit of electrode part 229A, and the intermediate transfer body 12 can be charged. That is, only the specified area is charged, not only in the sub-scanning direction but also in the main scanning direction, and the ink receptive particle layer 16A can be formed only in the specified area depending on the size (paper size) of recording medium 8 or image area.

As compared with the charging roll 129 (see FIG. 13) consisting of a plurality of small rolls 129A in the first modified example, the needle electrodes 229 consisting of a plurality of electrode parts 229A can control the area more finely because the electrode parts 229A can easily control the charged area to be more narrower than with the small rolls 129A.

Although not shown in the diagram, same effects are obtained in the brush charger having small brushes arranged in the main scanning direction.

A third modified example is shown.

As shown in FIG. 18A to FIG. 20, a particle supply device 318 comprises a particle supply roll 318A, and a charging blade 320 for pressing the particle supply roll 318A. The charging blade 320 is composed of a plurality of blade parts 320A (see FIG. 19, FIG. 20). Each blade part 320A has a corresponding cam 322. A motor (not shown) is connected to rotary shaft 322A of the cam 322, and the rotational angle of the motor is controlled by the control unit 200 (see FIG. 11), and the pressing force can be varied in every blade part 320A. Hence, the pressing force is varied in the unit of each blade part 320, and the amount (layer thickness) of ink receptive particles 16 carried on the surface of the particle supply roll 318A can be controlled.

That is, when the blade part 320A is pressing the particle supply roll 318A (FIG. 18A), ink receptive particles 16 are not carried on the surface of the particle supply roll 318A (or the layer thickness is very thin), so that the ink receptive particle layer 16A may not be substantially formed on the intermediate transfer body 12.

When the blade part 320A is apart from the particle supply roll 318A (FIG. 18A), a specified amount of ink receptive particles 16 can be carried on the particle supply roll 318A, corresponding to an arbitrary area in main scanning direction that is determined according to the width of each blade part 320A, so that the ink receptive particle layer 16A can be formed on the intermediate transfer body 12.

In the first modified example and second modified example, by turning on and off the charging device, the intermediate transfer body 12 is charge in a specified area in sub-scanning direction, and an ink receptive particle layer 16A is formed, but in this modified example, by changing over the totally pressed state (FIG. 18B) on the blade part 320A and the totally departed state (FIG. 18A), the ink receptive particle layer 16A can be formed on the intermediate transfer body 12 only in the specified area in sub-scanning direction.

Figure 19:
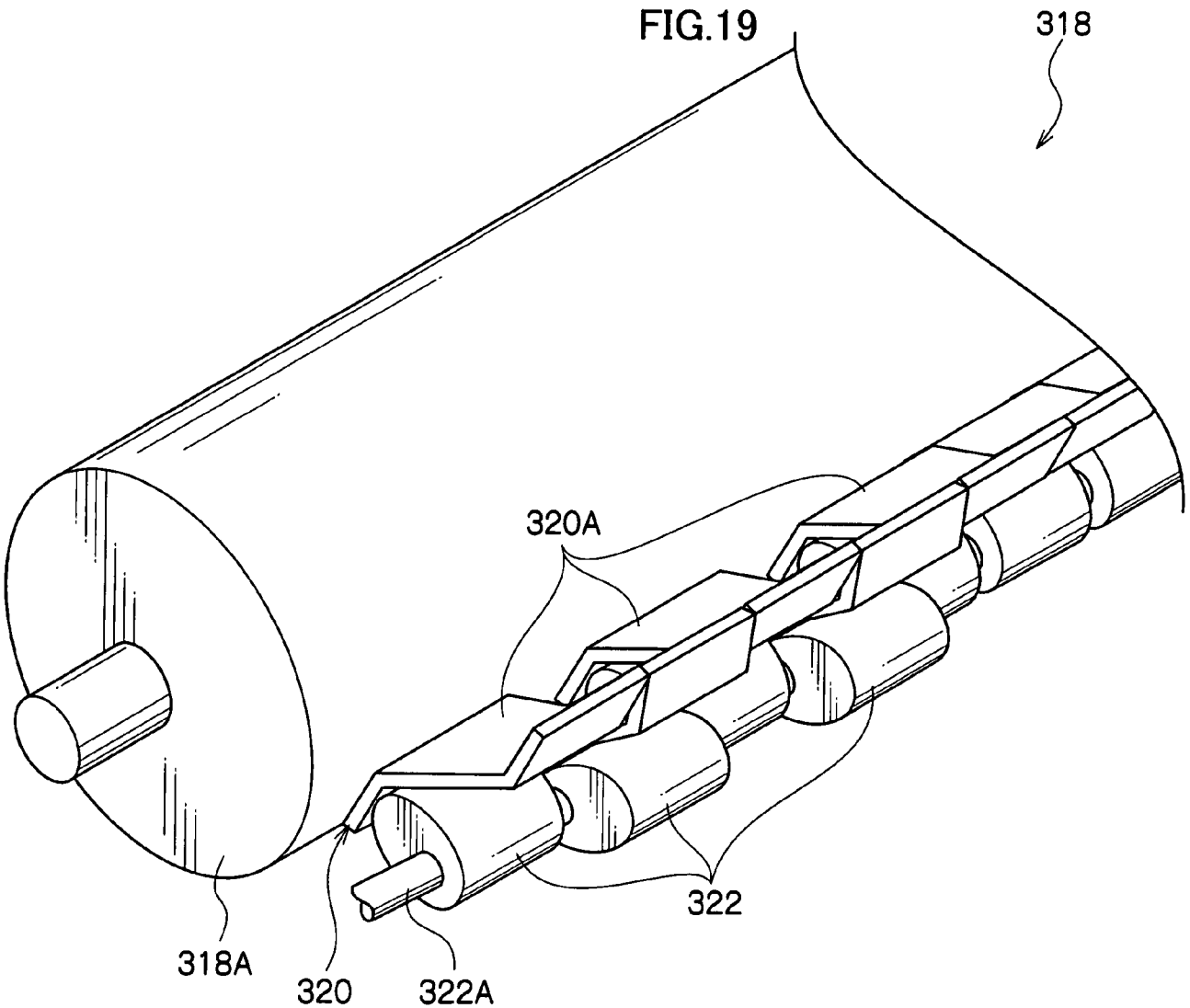
FIG. 19 is a perspective view of the third modified example.
Figure 20:
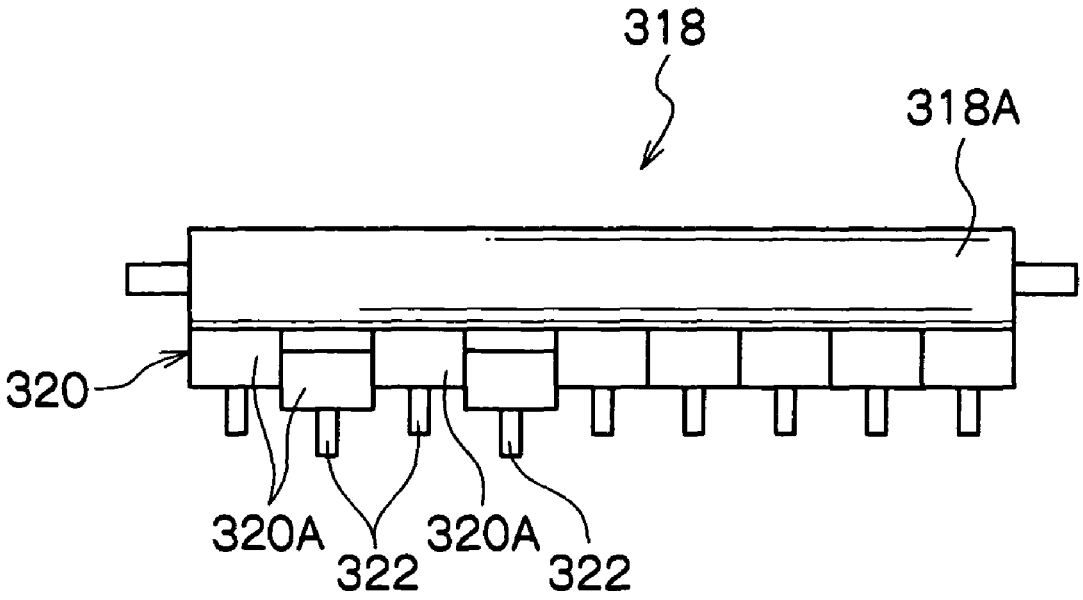
FIG. 20 is a plan view of the third modified example.

Moreover, in the unit of each blade 320A, by controlling in departed state (FIG. 18B), corresponding to an arbitrary area in main scanning direction (that is determined according to the width of each blade part 320A), a specified amount of ink receptive particles 16 can be carried on the particle supply roll 318A, and the ink receptive particle layer 16A can be formed on the intermediate transfer body 12 (see FIG. 19, FIG. 20).

A fourth modified example is explained.

Figure 21A:
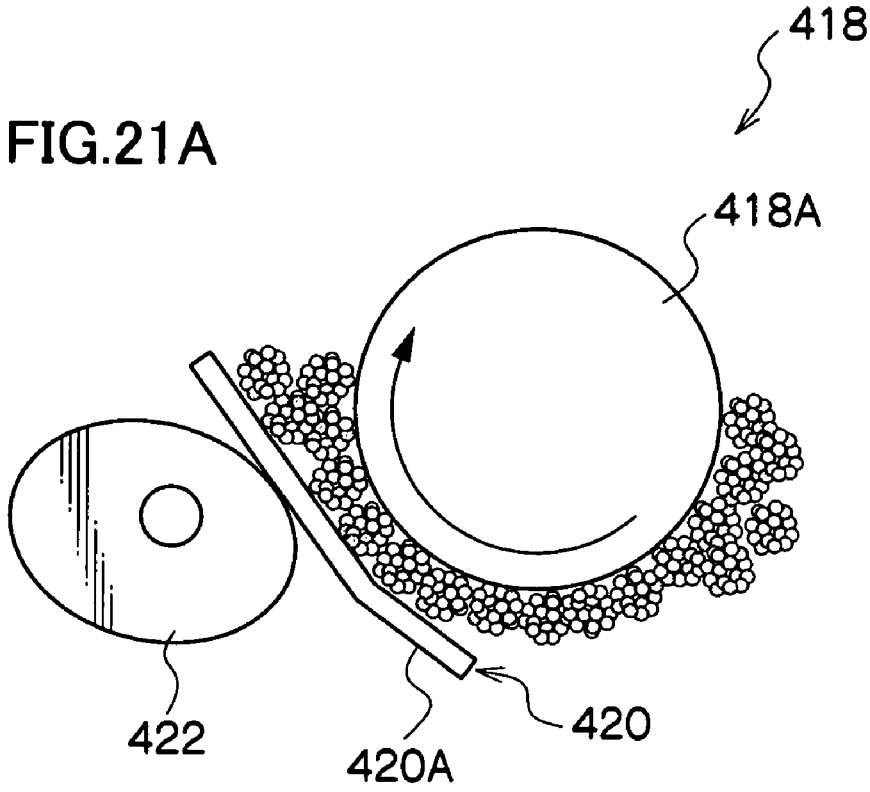
Figure 21B:
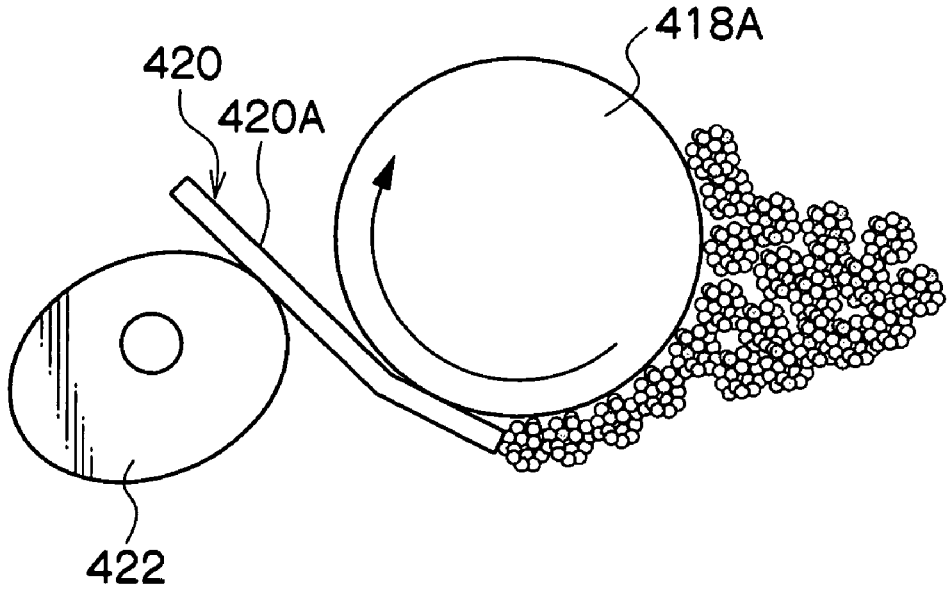

As shown in FIG. 21A, a particle supply device 418 does not, unlike the third modified example, control the coating amount (carrying amount) of ink receptive particles 16 on the particle supply roll by the pressing force of the charging blade, but controls the coating amount (carrying amount) of ink receptive particles 16 by scraping off the ink receptive particles 16 applied on the particle supply roll by a defining blade 420 before facing the intermediate transfer body 12.

The defining blade 420 is composed of a plurality of blade parts 420A. Each blade part 420A has a corresponding cam 422. A motor (not shown) is connected to rotary shaft of the cam 422, and the rotational angle of the motor is controlled by the control unit 200 (see FIG. 11), and the pressing force can be varied in every blade part 420A. Hence, the pressing force is varied in the unit of each blade part 420A, and the amount of ink receptive particles 16 carried on the surface of the particle supply roll 418A can be controlled.

As in the third modified example, the charging blade is necessary in the layer forming (developing) method of one-component system which is the developing method of electrophotographic method, but the charging blade is not needed in the layer forming (developing) method of two-component system using magnetic particles (carrier), and in such a case, it is effective to scrape off by a defining blade as in the fourth modified example.

When applying the two-component system, the layer of ink receptive particles 16 on the particle supply roll is grown to several millimeters because the carrier forms the magnetic brush. Hence, a layer can be formed in the intermediate transfer body 12 in contact-free state (at a gap of about 0.5 to 1 mm) between the intermediate transfer body 12 and particle supply roll. In this case, the defining blade contacts with the particle supply roll, and the ink receptive particle layer on the roll may not need to be completely eliminated, and a proper thickness (for example, about 0.5 mm if the distance between the intermediate transfer body 12 and particle supply roll is about 1 mm) of ink receptive particle layer may be left over on the particle supply roll. Even in this state, the ink receptive particles 16 do not contact with the intermediate transfer body 12, and ink receptive particle layer 16A is not formed on the intermediate transfer body 12.

In the third modified example and fourth modified example, formation of ink receptive particle layer 16A in sub-scanning direction may be controlled by on/off switching of high voltage power source to the particle supply roll. Further, when controlling only the formation of ink receptive particle layer 16A in sub-scanning direction, the charging blade 320 and defining blade 420 may not be divided into a plurality of sections, but may be formed to be sole part.

A pattern forming apparatus in a second exemplary embodiment of the invention is described.

Figure 4A:
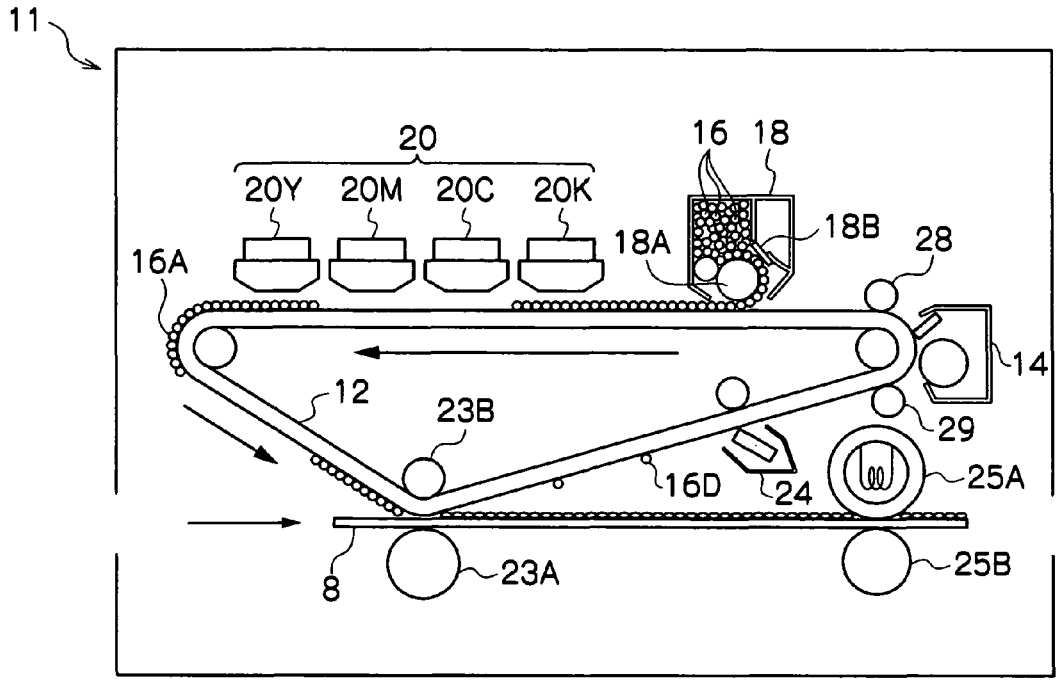
FIG. 4A is a diagram showing a pattern forming apparatus in a second embodiment of the invention.

As shown in FIG. 4A, a pattern forming apparatus 11 of the embodiment is basically same in structure as in the first embodiment, except that the transfer fixing process is separated into transfer and fixing.

More specifically, the ink receptive particle layer 16A on the intermediate transfer body 12 is nipped between the transfer roller 23A of the transfer device 23 and the driven roller 23B, which are opposite each other and between which the intermediate transfer body 12 is placed, and the ink receptive particle layer 16A is transferred onto the recording medium 8.

Then, the ink receptive particle layer 16A transferred onto the recording medium 8 is nipped between the fixing roll 25A and the driven roller 25B, which are opposite each other and between which the recording medium 8 is placed, and the ink receptive particle layer 16A is fixed on the recording medium 8.

Thus, by separating into an image transfer operation and fixing operation, the image fixing property can be enhanced without sacrificing print speed. By the secondary fixing operation, pressure in the transfer process of the ink receptive particle layer 16A can be lowered, and the load on the intermediate transfer body 12 and transfer device 23 can be lessened.

Further, by separating into an image transfer operation and fixing operation, it is easier to control the pressure and heating, and it is also becomes easy to control the characteristics of the surface of ink receptive particle layer 16A after being transferred on the recording medium 8, and the gloss can be controlled more smoothly.

Figure 4B:
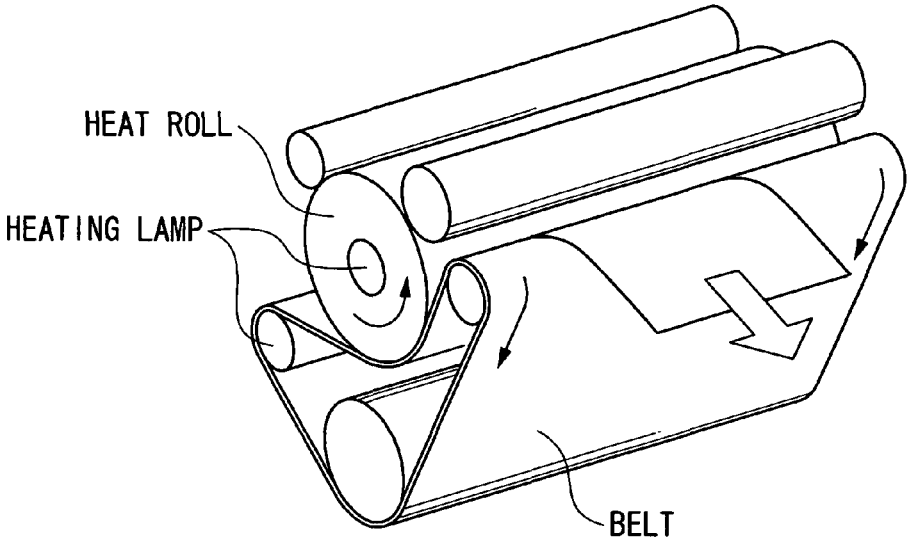
FIG. 4B is a diagram showing other example of fixing device.

Further, as the structure of fixing device 25, it is easier to select a belt nip system capable of extending the nip area, as shown in FIG. 4B.

Same as in the first embodiment, the ink receptive particle layer 16A can be formed only in the specified area of the intermediate transfer body 12. The pattern forming apparatus may be formed similarly according to any one of the first through fourth modified examples.

A pattern forming apparatus in a third exemplary embodiment of the invention is described.

Figure 5:
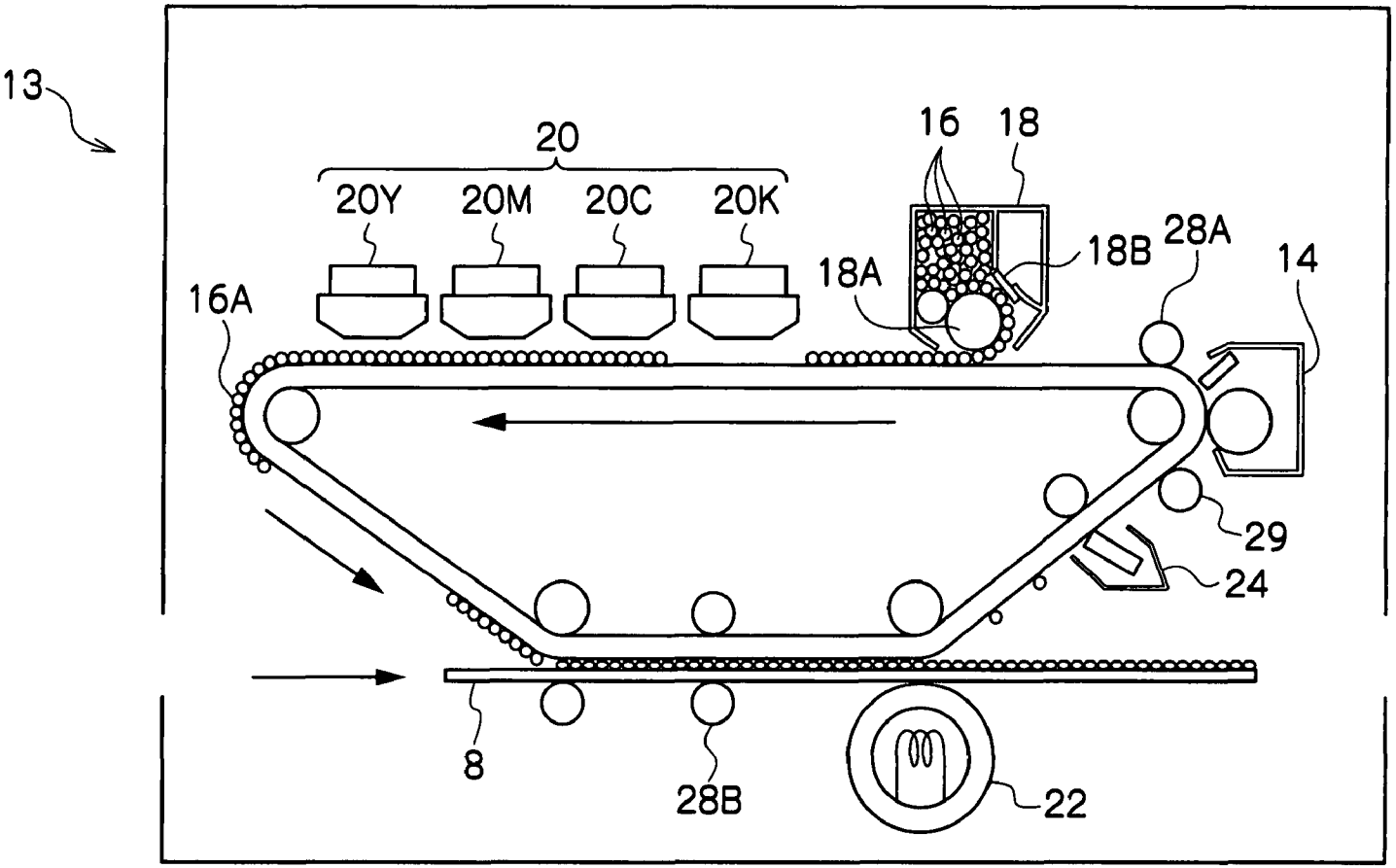
FIG. 5 is a diagram showing a pattern forming apparatus in a third embodiment of the invention.

As shown in FIG. 5, a pattern forming apparatus 13 comprises an endless belt-shaped intermediate transfer body 12, a charging device 28A for charging the surface of the intermediate transfer body 12, a particle applying device 18 for forming a particle layer by applying and adhering ink receptive particles 16 in a uniform and specified thickness in a charged region on the intermediate transfer body 12, an ink jet recording head 20 for forming an image by ejecting ink droplets onto the particle layer, a charging device 28B for charging the back side, that is, the non-image forming side of the recording medium 8, and a transfer fixing device 22 for transferring an ink receptive particle layer 16A onto the recording medium 8 by overlapping the intermediate transfer body 12 with a recording medium 8, and by applying pressure and heat.

In this embodiment, a charging process on the back side of recording medium (opposite side of image forming side) takes place before the transfer fixing process in the first embodiment.

Since the particle layer 16C is non-image area within the ink receptive particle layer 16A and is free from ink, the fixing particles 16E are not softened by the ink solvent (see FIG. 2B and FIG. 3A). In the first embodiment, the ink receptive particle layer 16A is transferred to the recording medium 8 by adding heat together with pressure at the transfer fixing portion 22.

The current embodiment is characterized, before the transfer fixing process, the recording medium 8 is applied a voltage from the back side thereof. The ink receptive particles 16 in the non-image area that is adsorbed electrostatically onto the surface of intermediate transfer body 12 is electrostatically transferred onto the surface of the recording medium 8.

Since the ink receptive particles 16 of the ink image layer 16B have absorbed the ink, they are transferred and fixed onto the side of recording medium 8 when pressed. However, since the particle layer 16C of the non-image portion is electrostatically adsorbed to the intermediate transfer body 12, it may be difficult to be transferred in that state. Accordingly, to transfer the particle layer 16C in the non-image portion, an electric field is formed between the recording medium 8 and the particle layer 16A, and the ink receptive particle layer 16A on the surface of intermediate transfer body 12 is adhered to the recording medium 8 and is transferred by electrostatic force.

Specifically, by using a conductive roll, an electric charge of reverse polarity of the ink receptive particles 16 is applied directly to the back side of the recording medium 8 so as to transfer the particle layer 16A to the recording medium 8. Or an electric charge may be applied by a corona discharger.

Alternatively, the ink image layer 16B absorbs moisture in the ink, and therefore, is provided with flexibility, and by pressing the ink image layer 16B placed between the intermediate transfer body 12 and recording medium 8, it is transferred to the recording medium 8. Here, in order to transfer the particles of the ink image layer 16B, the ink receptive particles 16 may be heated to above the glass transition point by a heating device to carry out the transfer.

Herein, by applying the electrostatic transfer technology of electrophotography, transfer onto the surface of recording medium 8 can be carried out by applying a voltage of reverse polarity to the charging polarity of ink receptive particles 16 by a conductive roller (charging device 28B in the embodiment). At this time, it is possible to apply a sufficient voltage for forming an electric field for removing off the ink receptive particles 16 electrostatically adsorbed onto the surface of intermediate transfer body 12.

Since the applied voltage and other mechanical conditions are determined depending on the ink receptive particles or intermediate transfer body, by optimizing each condition, desired results may be obtained. By the above configuration, the transfer efficiency of ink receptive particles in the particle layer of the non-image portion can be enhanced.

Same as in the first embodiment, the ink receptive particle layer 16A can be formed only in the specified area of the intermediate transfer body 12. The pattern forming apparatus may be formed similarly according to any one of the first through fourth modified examples.

A pattern forming apparatus in a fourth embodiment of the invention is described.

Figure 6:
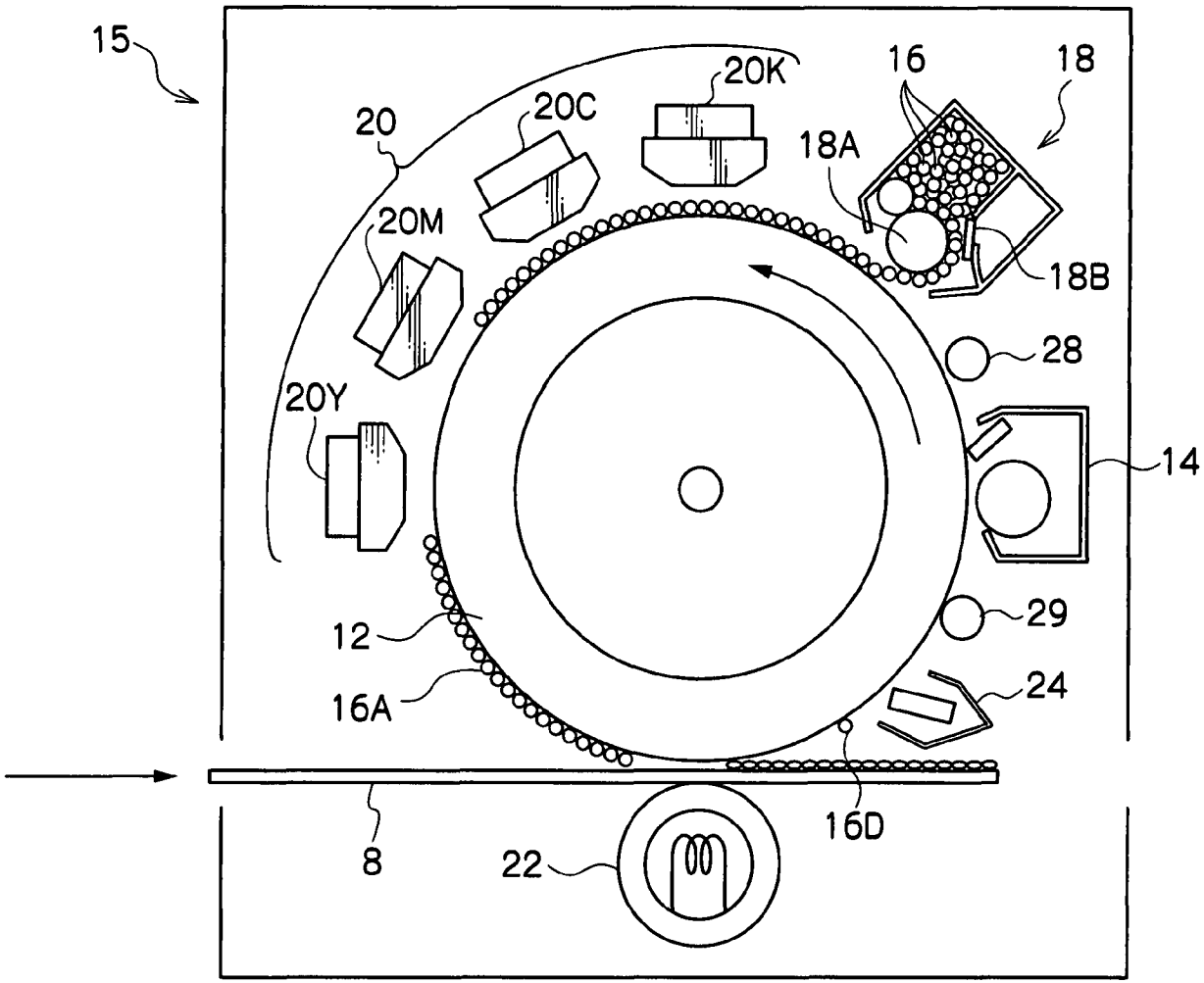
FIG. 6 is a diagram showing a pattern forming apparatus in a fourth embodiment of the invention.

As shown in FIG. 6, a pattern forming apparatus 15 comprises an intermediate transfer body 12 in a drum shape, a charging device 28 for charging the surface of the intermediate transfer body 12, a particle applying device 18 for forming a particle layer by applying and adhering ink receptive particles 16 in a uniform and specified thickness in a charged region on the intermediate transfer body 12, an ink jet recording head 20 for forming an image by ejecting ink droplets onto the particle layer, and a transfer fixing device 22 for transferring and fixing an ink receptive particle layer onto a recording medium 8 by overlapping the intermediate transfer body 12 with the recording medium 8, and by applying pressure and heat.

In the fourth embodiment, the belt type intermediate transfer body 12 in the first embodiment is replaced by an intermediate transfer drum.

In the intermediate transfer body 12 of this embodiment, a conductive substrate of aluminum or aluminum alloy having the surface treated by anodic oxidation is used. As the aluminum alloy, aluminum/magnesium alloy, aluminum/titanium alloy or the like may be used. The surface of these materials is preferably finished to a mirror smooth surface in order to form a uniform layer of anodic oxide film.

Anodic oxidation is preferably carried out under the conditions of voltage of 5 to 500 V and current density of 0.1 to 5 $A/dm^2$, in an acidic bath of chromic acid, sulfuric acid, oxalic acid, boric acid or phosphoric acid. Thickness of anodic oxide film is preferred to be about 2 to 50 μm, or more preferably about 5 to 15 μm. An anodic oxidation surface is often porous, however since a porous surface is chemically unstable, it is preferably treated by hydration pore sealing by using boiling water or steam.

In this embodiment, the mirror finished surface of aluminum pipe is anodically oxidized in sulfuric acid at a current density of 1.5 $A/dm^2$, and an anodic oxide film of 7 μm is formed, and sealed by boiling water.

As the drum-shaped intermediate transfer body 12 is more rigid as compared with the belt type intermediate transfer body, it is easier to keep a specified distance between the nozzle surface of the ink jet recording head 20 and the surface of intermediate transfer body 12. In a case of multipass recording, that is performed in ink jet recording in order to enhance the image quality by dividing the image recording operation at plural times, as compared with the belt type intermediate transfer body, the drum-shaped intermediate transfer body is advantageous because recording position can be precisely assured in repeated recording.

Same as in the first embodiment, the ink receptive particle layer 16A can be formed only in the specified area of the intermediate transfer body 12. The pattern forming apparatus may be formed similarly according to any one of the first through fourth modified examples.

A pattern forming apparatus in a fifth exemplary embodiment of the invention is described.

Figure 7:
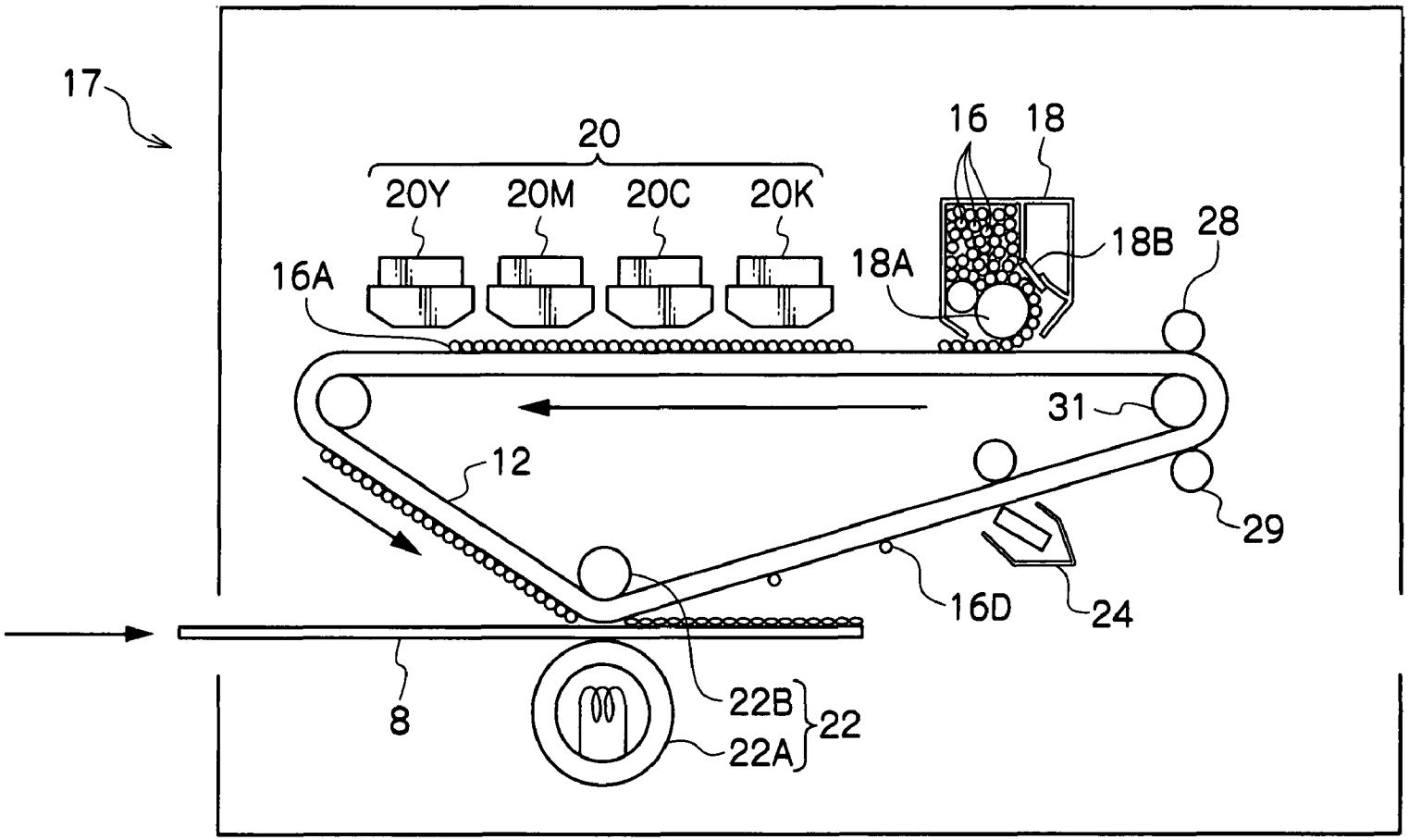
FIG. 7 is a diagram showing a pattern forming apparatus in a fifth embodiment of the invention.

As shown in FIG. 7, the pattern forming apparatus 17 of the embodiment is similar to the first embodiment (FIG. 1), except that the releasing agent applying device 14 is omitted.

In the embodiment, it is configured that the surface of intermediate transfer body 12 is formed as a releasing layer (releasing material). As the intermediate transfer body 12, a surface layer of tetrafluoroethylene-perfluoroalkyl vinyl ether copolymer of 400 μm in thickness is formed on a base layer of urethane material of 2 mm in thickness.

Since the surface layer of intermediate transfer body 12 has a releasing property with respect to the ink receptive particles 16, when transferring and fixing, the ink receptive particle layer is transferred efficiently from the intermediate transfer body to the recording medium. Moreover, since the surface layer has a releasing property and also a water repellent property, ink solvent permeating into the ink receptive particle layer does not adhere to the surface of intermediate transfer body 12, and is held in the ink receptive particles 16, and transferred to the recording medium 8. That is, the ink solvent does not remain on the surface of intermediate transfer body 12, and there is no adverse effect on supply of ink receptive particles 16 and others to the intermediate transfer body 12. Hence it is not required to form a releasing layer by applying releasing agent, which contributes to simplification, miniaturization, and low cost on the apparatus.

Same as in the first embodiment, the ink receptive particle layer 16A can be formed in the intermediate transfer body 12 only in specified area. The pattern forming apparatus may be formed similarly according to any one of the first through fourth modified examples.

According to the foregoing embodiments, waste of liquid receptive particles can be saved in the pattern forming process and pattern forming apparatus of intermediate transfer system using a liquid droplet ejecting apparatus.

<Constituent Components>

Constituent components in the first embodiment (including modified examples) through fifth embodiment are specifically described below.

Unless otherwise specified in the first embodiment to the fifth embodiment, in principle, the following constituent elements can be used.

<Ink Receptive Particles>

Ink receptive particles used in the exemplary embodiments of the invention are specified as follows.

Ink receptive particles in the embodiments receive the ink. The property, "ink receptive" means that the ability to retain at least part of the ink components (at least a liquid component). The ink receptive particles in the embodiments of the invention have a trap structure for trapping at least a liquid component of the ink and includes a liquid absorbing resin.

Herein, the "trap structure" is a physical particle wall structure for retaining at least liquid, and specific examples thereof include a void structure, recess structure or capillary structure. The maximum diameter of openings (apertures) in these structures is preferred to be 50 nm to 5 μm, and more preferably 300 nm to 1 μm. In particular, the maximum diameter of openings is preferred to be large enough to trap the recording material, for example, the pigment of volume average particle diameter of 100 nm. However, together with these openings, fine pores of less than 50 nm in the maximum diameter of openings may also be provided. From the viewpoint of improvement of liquid absorbing property, voids, capillary, or the like preferably may communicate with each other inside the particles.

It is desirable that the trap structure traps not only the liquid components of the ink components but also the recording material. Together with the ink liquid components, when the recording material, in particular, pigments are trapped in the trap structure, the recording material is retained and fixed within the ink receptive particles without being unevenly distributed. This contributes to achieve both high speed recording and high image quality at the same time. Ink liquid components are mainly ink solvents (dispersion media: vehicle liquid).

When the ink receptive particles receive the ink, first the ink adheres to the ink receptive particles, and at least a liquid component of the ink is trapped by the trap structure. At this time, the recording material, regardless whether it is a pigment or dye of the ink component, is adhered to the ink receptive particle surface or is trapped by the trap structure. The trapped liquid components of the ink are absorbed by the liquid absorbing resin. Thus, the ink receptive particles receive the ink. The ink receptive particles receiving the ink are transferred on the recording medium, and the image is recorded.

Trapping of ink liquid components by this trap structure is physical capturing by particle wall structure, and it is very fast as compared with absorbing of liquid by liquid absorbing resin, and the ink receptive particles receiving the ink can be transferred to various recording media in a short time, regardless whether the recording medium is permeable or impermeable. Moreover, since the trapped liquid components of the ink are absorbed by the liquid absorbing resin, and the retention stability for the liquid components of the ink improves, so that, at the time of transfer, the ink receptive particles having received the ink do not cause liquid components to leak out or bleed if physical force is applied.

Therefore, even when using various types of ink, recording is possible with various recording media at high speed and with high image quality.

Moreover, since ink receptive particles are transferred onto the recording medium with the ink liquid components completely trapped, curling or cockling of the recording medium, or lowering of the strength of recording medium, due to liquid absorption by the recording medium can be prevented.

After transfer of ink receptive particles, the liquid absorbing resin functions as a binder resin or coating resin for recording material, and the fixing property of the recording material and the fixing property (rubbing resistance) of recorded matter can be enhanced, and the gloss of recorded matter can be controlled. Further, regardless whether the recording material is pigment or dye, high color formation can be obtained.

In order to improve the fixing property (rubbing resistance) for ink (for example, pigment ink) which contains insoluble components, dispersed particles such as pigment as recording material, a large amount of polymer needs to be added to the ink. However, when a large amount of polymer is added to the ink (including treatment liquid), the nozzle of the ink ejecting unit may clog. In the embodiments of the invention, by contrast, since the liquid absorbing resin functions as such polymer, high image quality, high fixing property, and high reliability of the system can all be satisfied.

Figure 8:
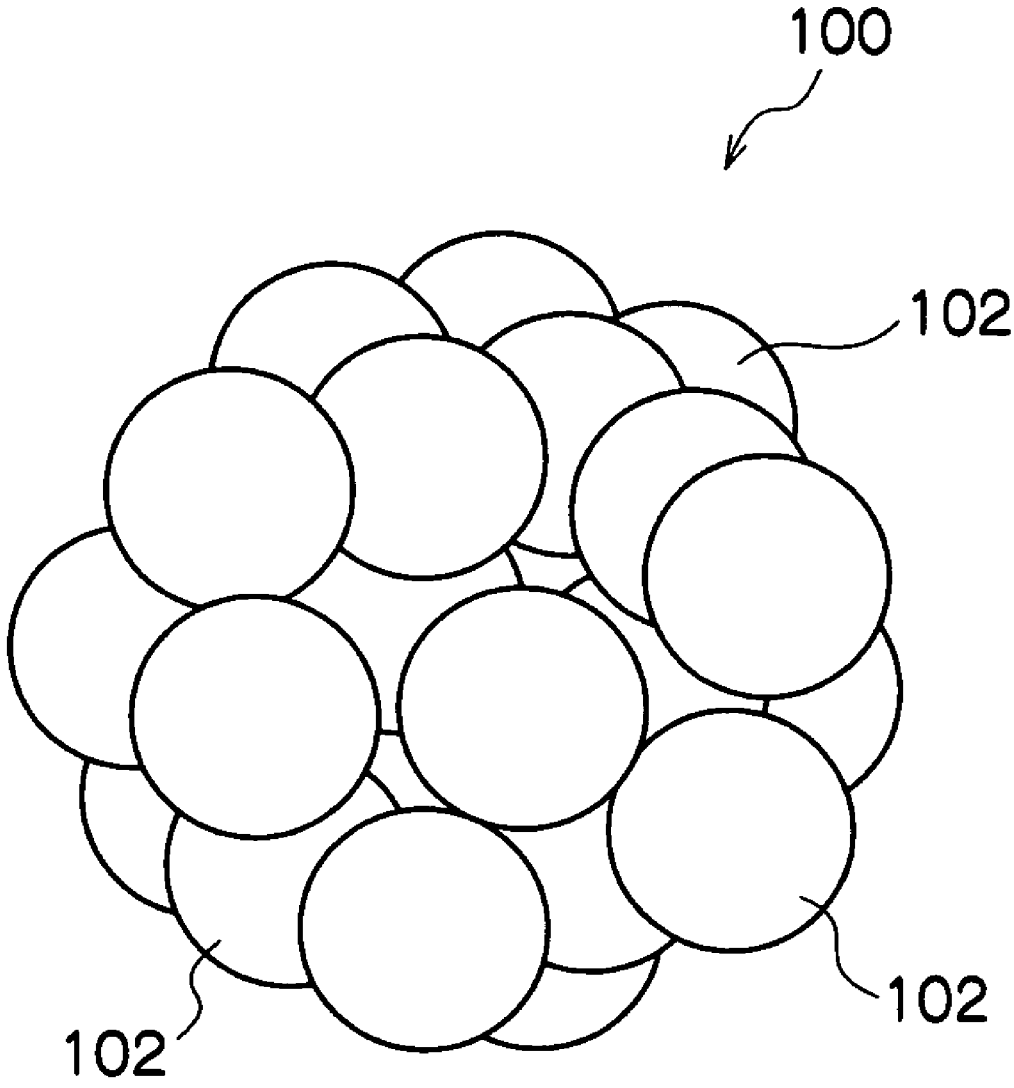
FIG. 8 is a conceptual diagram of an example of ink receptive particles of the invention.
Figure 9:
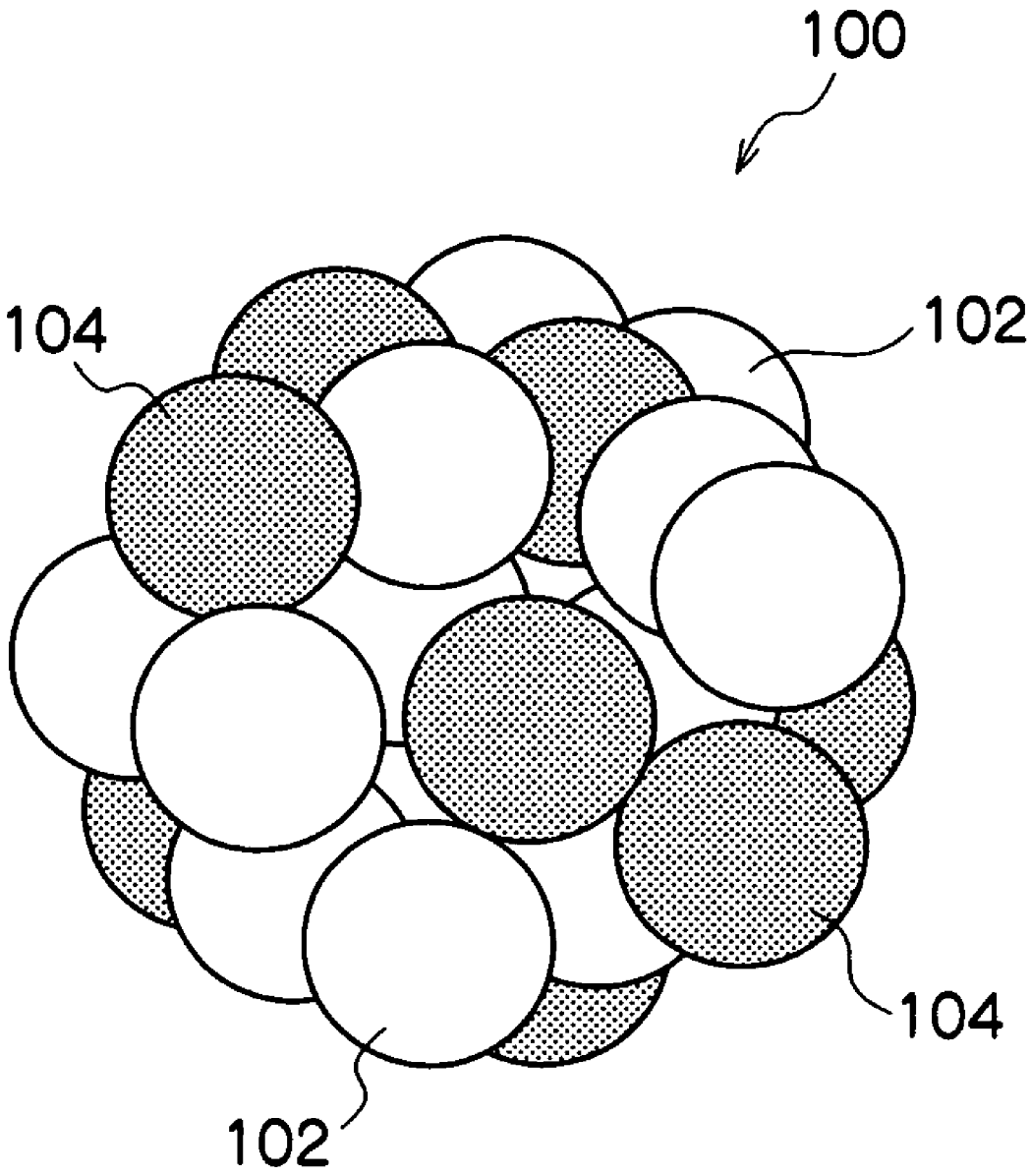
FIG. 9 is a conceptual diagram of other example of ink receptive particles of the invention.

Ink receptive particles in the embodiments of the invention may preferably be, for example, composite particles 100, in which particles 102 of liquid absorbing resin are aggregated as shown in FIG. 8, in order to provide the trap structure as mentioned above. Further, to improve the liquid absorbing property of ink liquid components, ink receptive particles in the embodiments of the invention are particularly preferred to be composite particles 100 in which inorganic particles 104, in addition to particles 102 of liquid absorbing resin, are aggregated as shown in FIG. 9. Thus, water absorbing property, charging and conductive properties and other functions can be achieved. In these composite particles, a void structure can be formed by gaps between particles.

The volume average particle size of liquid absorbing resin particles is preferred to be 50 nm to 10 μm, more preferably 0.1 μm to 5 μm, and still more preferably 0.2 μm to 2 μm. The volume average particle size of inorganic particles is preferred to be 10 nm to 30 μm, more preferably 50 nm to 10 μm, and still more preferably 0.1 μm to 5 μm. The particles of liquid absorbing resin and inorganic particles may be either primary particles or aggregates by agglomeration of primary particles.

These composite particles are obtained, for example, by agglomerating particles in a semi-sintered state. A semi-sintered state is a state in which some of the granule shape remains and voids are retained between particles. When an ink liquid component is trapped in the trap structure, part of the composite particles may be dissociated, that is, composite particles may be broken up, and particles composing the composite particles may be scattered.

The inorganic particles include colorless, pale color, white particles, or the like, and specific examples thereof include colloidal silica, alumina, calcium carbonate, zinc oxide, titanium oxide, tin oxide, and the like. These inorganic particles may be surface treated (partial hydrophobic treatment, introduction of specific functional group, etc.). In the case of silica, for example, a hydroxyl group in silica is treated with a silylating agent such as trimethyl chlorosilane or t-butyl dimethyl chlorosilane to introduce an alkyl group. Then dehydrochlorination takes place by silylating agent and reaction progresses. When an amine is added to this reaction system, hydrochloric acid is transformed into hydrochloride, and therefore, reaction is promoted. The reaction can be controlled by regulating the treating amount or treating conditions of a silane coupling agent having an alkyl group or phenyl group as a hydrophobic group, or a coupling agent such as titanate system or zirconate system. Similarly, surface treatment can also be carried out by using aliphatic alcohols, higher fatty acids, or derivatives thereof. Further, for the surface treatment, a coupling agent having a cationic functional group such as a silane coupling agent having quaternary ammonium salt structure, (substituted) amino groups, or the like, silane, a coupling agent having fluorine functional group such as fluorosilane, and other coupling agents having anionic functional group such as carboxylic acid may be used. In particular, inorganic particles are porous and are preferred from the viewpoint of affect of the liquid absorbing property on the ink receptive particles.

Figure 10:
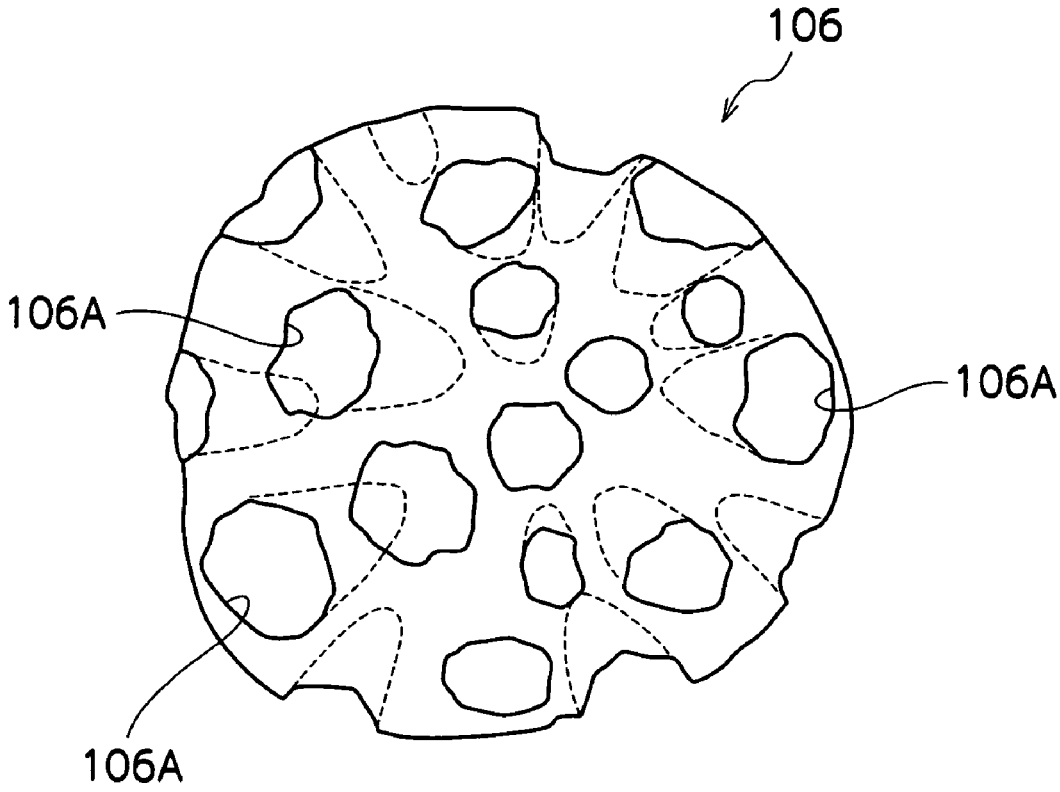
FIG. 10 is a conceptual diagram of another example of ink receptive particles of the invention.

Ink receptive particles of the embodiments of the invention, if having trap structure such as void structure, recess structure or capillary structure, may be composed of particles 106 of liquid absorbing resin having a recess 106A (for example, with maximum aperture diameter of 100 nm or more, preferably 200 nm to 2000 nm) on the surface as shown in FIG. 10, which are obtained, for example, by lost wax method or obtained by solidifying and crushing molten resin or dissolved resin containing bubbles inside by injection of gas or incorporation of foaming agent. However, the most preferred example is composite particles obtained by the above agglomeration method.

Particle size of ink receptive particles of the embodiments of the invention is preferred to be 0.5 μm to 60 μm, more preferably 1 μm to 30 μm, or still more preferably 3 μm to 15 μm, in average spherical equivalent diameter. The average spherical equivalent diameter is determined as follows. Optimum method depends on particle size, however, for example, a method that particle size is determined by applying a light scattering principle to a dispersion of the particles in a liquid, or a method that particle size is determined by image processing for a projected image of particles, or other methods may be used. Examples which can be given of generally used methods include a Microtrack UPA method (trade name) or Coulter counter method.

The liquid absorbing resin will be explained hereinafter. In the liquid absorbing resin, since the absorbed ink liquid component (for example, water-based solvent) acts as a plasticizer of resin (polymer), it is softened and the fixing property is improved. Accordingly, the ink receptive particles can be transferred (fixed) on plain paper as a recording medium only by pressing (however, for improving the gloss of recorded matter, heating and pressing may be effective). However, if absorbing liquid is too much to be swollen, bleeding may occur and fixing property decreases, and therefore, the liquid absorbing resin is preferred to be a resin that absorbs liquid weakly (hereinafter, called as "weak liquid absorbing resin"). The weak liquid absorbing resin is, for example, when absorbing water as liquid, a hydrophilic resin capable of absorbing liquid from several percent (approximately 5 percent) to several hundreds of percent (approximately 500 percent) relative to mass of the resin, preferably approximately 5% to 100%.

If the liquid absorbing property is less than approximately 5%, the liquid trapped in the voids may flow out from the voids at the time of transferring (or fixing), and the image quality deteriorates. Besides, since the plasticization of resin is insufficient, a greater energy is needed for fixing. To the contrary, if the liquid absorbing capacity is too high, not only liquid absorption, but also moisture absorption is active, and therefore, dependence of ink receptive particles on handling environment is higher, and it may be hard to use. For example, by crosslinking the resin at high degree, it is possible to avoid mutual fusion of particles if absorbing moisture (for example, commercial water absorbing resin). In such a case, however, it may be hard to fix on the recording medium. In the case of weak liquid absorbing resin, since the liquid absorbing speed of resin is considerably slower than in the strong liquid absorbing resin, it is an important point in designing of structure and properties of ink receptive particles so as to trap the liquid in the void structure initially, and then absorb liquid in the resin.

From such point of view, the liquid absorbing resin is composed of, for example, a homopolymer of a hydrophilic monomer, or a copolymer composed of both a hydrophilic monomer and a hydrophobic monomer. The copolymer is preferred for obtaining a weak water absorbing resin. In addition to the monomers, graft copolymers or block copolymers may be used by copolymerizing a unit of polymer/oligomer structure as a starting material with other unit.

Examples of the hydrophilic monomer include monomers including —OH; -EO unit (ethylene oxide group); —COOM wherein, M is, for example, a hydrogen, an alkaline metal such as Na, Li, K, or the like, an ammonia, an organic amine, or the like; —SO3M (M is, for example, a hydrogen, an alkaline metal such as Na, Li, K, or the like, an ammonia, an organic amine, or the like); —NR3 wherein, R is H, alkyl, phenyl, or the like; NR4X wherein, R is H, alkyl, phenyl, or the like, and X is a halogen, a sulfate radical, acidic anions such as a carboxylic acid, BF4, or the like. Specific examples of the hydrophilic monomer include 2-hydroxy ethyl methacrylate, 2-hydroxy ethyl acrylate, acrylamide, acrylic acid, methacrylic acid, unsaturated carboxylic acid, crotonic acid, and maleic acid, and the like. Examples of a hydrophilic unit or monomer include cellulose derivatives such as cellulose, ethyl cellulose, carboxy methyl cellulose, or the like; polymerizable carboxylates such as starch derivatives, monosaccharides, polysaccharides, vinyl sulfonic acid, styrene sulfonic acid, acrylic acid, methacrylic acid, (anhydrous) maleic acid, or the like or (partially) neutralized salts thereof; vinyl alcohols; vinyl pyrrolidone, vinyl pyridine, amino (meth) acrylate or dimethyl amino (meth)acrylate derivatives, or onium salts thereof; amides such as acrylamide, isopropyl acrylamide, or the like; vinyl compounds containing polyethylene oxide chain; vinyl compounds containing hydroxyl group; polyesters composed of multifunctional carboxylic acid and polyhydric alcohol; especially branched polyesters having trifunctional or higher acids such as trimellitic acid and containing plural carboxylic acids or hydroxyl groups at the end portion; polyesters having polyethylene glycol structure, and the like.

The hydrophobic monomers are monomers having a hydrophobic group, and specific examples thereof include olefin (tyrene, butadiene, or the like), styrene, alpha-methyl styrene, alpha-ethyl styrene, methyl methacrylate, ethyl methacrylate, butyl methacrylate, acrylonitrile, vinyl acetate, methyl acrylate, ethyl acrylate, butyl acrylate, lauryl methacrylate, and the like. Examples of a hydrophobic unit or monomer include styrene derivatives such as styrene, alpha-methyl styrene, vinyl toluene; polyolefins such as vinyl cyclohexane, vinyl naphthalene, vinyl naphthalene derivatives, alkyl acrylate, phenyl acrylate, alkyl methacrylate, phenyl methacrylate, cycloalkyl methacrylate, alkyl crotonate, dialkyl itaconate, dialkyl maleate, polyethylene, ethylene/vinyl acetate, polypropylene or the like; and derivatives thereof.

Specific examples of liquid absorbing resin composed of copolymers of the hydrophilic monomer and the hydrophobic monomer include olefin polymers (or its modifications, or products into which a carboxylic acid unit is introduced by copolymerization, or the like) such as (meth)acrylate, styrene/(meth)acrylic acid/(anhydrous) maleic acid copolymer, ethylene/propylene, or the like, branched polyester enhanced in acid value by trimellitic acid or the like, polyamide, and the like.

Preferably, the liquid absorbing resin has a structure of neutralized salt (for example, carboxylic acid, or the like). The neutralized salt structure such as carboxylic acid can form an ionomer by interaction with a cation (for example, a monovalent metal cation such as Na, Li or the like), when absorbing ink containing the corresponding cation and thus, the fixing strength of final recorded matter improves. Moreover, the neutralized salt structure such as carboxylic acid promotes the aggregation of recording materials (for example, pigment or dye) having an anionic group and hence the image quality is also improved.

Preferably, the liquid absorbing resin contains a substituted or unsubstituted amino group, or a substituted or unsubstituted pyridine group. Such groups have a bactericidal effect or interaction with a recording material having anion group (for example, pigment or dye), and therefore, the image quality and fixing property are enhanced.

In the liquid absorbing resin, the molar ratio (the hydrophilic monomer:the hydrophobic monomer) of the hydrophilic unit (hydrophilic monomer) and the hydrophobic unit (hydrophobic monomer) is preferably 5:95 to 70:30, more preferably 7:93 to 60:40, still more preferably 10:90 to 50:50. In particular, the hydrophilic unit is preferably 5 to 70 mol % relative to the total amount of the liquid absorbing resin, more preferably 10 to 50 mol %. If the amount of the hydrophilic monomer is within the above range, the water absorbing speed and water absorbing amount are improved when the ink receptive particles absorb water-based liquid, and the handling performance of receptive particles in environments of high humidity to low humidity and balance of transfer and fixing property can be established.

The liquid absorbing resin may be straight chain structure or branched chain structure, preferably, the liquid absorbing resin is branched structure. The liquid absorbing resin may preferably be non-crosslinked or low-crosslinked. The liquid absorbing resin may be random copolymers or block copolymers of the straight chain structure, or may be more preferably polymers of branched structure including random copolymers, block copolymers and graft copolymers of branched structure. For example, in the case of polyesters synthesized by polycondensation, when the end group is increased by branched structure, it is easier to extend the control latitude of hydrophilic property, water absorbing property, and handling ability and fixing property of particles. Regardless of addition polymerization system or polycondensation system, when a carboxylic group is placed on the branched portion, supply of the cation from ink enable a final formation of a firmly fixed image having an ion crosslinking type. Such branched structure can be obtained by one of the popular techniques, that is, a trace (for example, less than 1%) of a crosslinking agent such as divinyl benzene or di(meth) acrylate is added at the time of synthesizing, or a large amount of an initiator is added together with the crosslinking agent. It is to be noted that fixing of recorded image may be difficult or energy required for fixing may be increased when forming a three-dimensional network by enhancing the crosslinking degree of the liquid absorbing resin like a commercial water absorbing resin. To assure the fixing property, even though a crosslinking reaction takes place, it is required to adjust so that the thermoplasticity is maintained sufficiently on the entire structure, while be kept in part.

The liquid absorbing resin may be ion-crosslinked by ions supplied from ink. When introducing a unit having carboxylic acid into the liquid absorbing resin, the strength of resin image after fixing tends to be higher. Examples of the unit having carboxylic acid include such as copolymers having a carboxylic acid such as (meth)acrylic acid or maleic acid, a (branched) polyesters having a carboxylic acid, and the like. It is estimated that ion crosslinking or acid-base interaction occurs between a carboxylic acid in the resin and alkaline metal cation, alkaline earth metal cation, organic amine•onium cation, or the like, which is supplied from liquid such as water-based ink, thereby reinforcing the fixed image.

When the liquid absorbing resin contains a polar group, it is preferred from a viewpoint of enabling hydrophilic property, and charging and conductive properties. The polar group contributing to hydrophilic property is the same as that for the hydrophilic monomer. Examples of the polar group include hydroxylic group, ethylene oxide group, carboxylate group, and amino group. The polar group contributing to charging and conductive properties is preferably a salt forming structure such as (substituted) amino group, (substituted) pyridine group or its amine salt, quaternary ammonium salt, and the like for positive charging, or is preferably an organic acid (salt) structure such as carboxylic acid (salt), sulfonic acid (salt), and the like for negative charging. It is further effective to add a charging regulator for electrophotographic toner such as a salt forming compound of quaternary ammonium salt of low molecular weight, organic borate, salicylic acid derivative, and the like, to the liquid absorbing resin. For controlling the conductivity, it is effective to add conductive or semiconductive inorganic materials such as tin oxide, titanium oxide, or the like.

The liquid absorbing resin is preferred to be a noncrystalline resin, and its glass transition temperature (Tg) is preferably 40 to 90 deg. C., or more preferably 50 to 70 deg. C. When the glass transition temperature is within this range, the particle handling property, image blocking property, and imaging fixing property are satisfied at the same time. The glass transition temperature (and melting point) is determined from the major maximum peak measured in accordance with ASTMD 3418-8, the disclosure of which is incorporated herein by reference. The major maximum peak can be measured by using DSC-7 (manufactured by Perkin Elmer). In this apparatus, temperature of detection unit is corrected by melting point of indium and zinc, and the calorimetric value is corrected by fusion heat of indium. For the sample, an aluminum pan is used, and for the control, an empty pan is set. Measurement is carried out at an elevated rate of temperature of 10 deg. C./min.

The weight-average molecular weight of the liquid absorbing resin is preferably 3,000 to 300,000, or more preferably 10,000 to 100,000. When the weight-average molecular weight is within this range, quick liquid absorption, fixing at a low energy, and strength of image after fixing can be satisfied at the same time. The weight-average molecular weight is measured under the following conditions. For example, the GPC is HLC-8120GPC, SC-8020 (manufactured by TOSOH CORPORATION), the column is two pieces of TSK gel, SuperHM-H (manufactured by TOSOH CORPORATION, 6.0 mm ID×15 cm), and the eluent is THF (tetrahydrofuran). The conditions of experiment is as follows: sample concentration of 0.5%, flow velocity of 0.6 ml/min, sample injection amount of 10 μl, measuring temperature of 40 deg. C., and IR detector. Calibration curve is prepared from ten samples of polystyrene standard samples TSK standards (manufactured by TOSOH CORPORATION), A-500, F-1, F-10, F-80, F-380, A-2500, F-4, F-40, F-128, and F-700.

Acid value of the liquid absorbing resin is 50 to 1000 as expressed by carboxylic acid groups (—COOH), more preferably 150 to 500, still more preferably 50 to 500, or particularly preferably 100 to 300. When the acid value is within this range, it is possible to control the handling and water absorbing properties of particles and fixing property. The acid value as expressed by carboxylic acid groups (—COOH) is measured as follows.

The acid value is measured by a neutralization titration method in accordance with JIS K 0070 (the disclosure of which is incorporated herein by reference). That is, a proper amount of sample is prepared, and to this sample, 100 ml of solvent (diethyl ether/ethanol mixture) is added together with several droplets of indicator (phenolphthalein solution). Then, the resulting mixture is stirred and mixed sufficiently in a water bath until the sample is dissolved completely. The solution is titrated with 0.1 mol/L of potassium hydroxide ethanol solution, and an end point is determined when a pale scarlet color of indicator continues for 30 seconds. Acid value (A) is calculated by the following equation:

$$A=(B\times f\times 5.611)/S$$

wherein, A represents acid value, S is the sample amount (g), B is the amount (ml) of 0.1 mol/L of potassium hydroxide ethanol solution used in titration, and f is a factor of 0.1 mol/L of potassium hydroxide ethanol solution.

Other additives for the ink receptive particles in the embodiments of the invention will be described below. The ink receptive particles in the embodiments of the invention are preferred to contain components for aggregating or thickening ink components. When such components are contained, recording materials (for example, pigment or dye) contained in ink are aggregated or polymers are thickened, and therefore, the image quality and fixing property are improved.

Components having such functions may be contained as functional groups, or as compound in the water absorbing resin. Examples of such functional group include carboxylic acid, polyhydric metal cation, polyamine, and the like.

Preferred examples of such compound include aggregating agent such as inorganic electrolyte, organic acid, inorganic acid, organic amine, and the like.

Examples of the inorganic electrolyte includes an alkali metal ion such as a lithium ion, a sodium ion, a potassium ion, a polyvalent metal ion such as an aluminum ion, a barium ion, a calcium ion, a copper ion, an iron ion, a magnesium ion, a manganese ion, a nickel ion, a tin ion, a titanium ion and a zinc ion, hydrochloric acid, hydrobromic acid, hydroiodic acid, sulfuric acid, nitric acid, phosphoric acid, thiocyanic acid, and an organic carboxylic acid such as acetic acid, oxalic acid, lactic acid, fumaric acid, citric acid, salicylic acid and benzoic acid, and organic sulfonic acid salts.

Specific examples of the inorganic electrolyte include an alkali metal salt such as lithium chloride, sodium chloride, potassium chloride, sodium bromide, potassium bromide, sodium iodide, potassium iodide, sodium sulfate, potassium nitrate, sodium acetate, potassium oxalate, sodium citrate, and potassium benzoate, and a polyvalent metal salt such as aluminum chloride, aluminum bromide, aluminum sulfate, aluminum nitrate, aluminum sodium sulfate, aluminum potassium sulfate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogen phosphate, calcium thiocyanate, calcium benzoate, calcium acetate, calcium salicylate, calcium tartrate, calcium lactate, calcium fumarate, calcium citrate, copper chloride, copper bromide, copper sulfate, copper nitrate, copper acetate, iron chloride, iron bromide, ion iodide, iron sulfate, iron nitrate, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogen phosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate.

Specific examples of the organic acid include arginine acid, citric acid, glycine, glutamic acid, succinic acid, tartaric acid, cysteine, oxalic acid, fumaric acid, phthalic acid, maleic acid, malonic acid, lycine, malic acid, compounds represented by Formula (1), and derivatives of the compounds.

Formula (1)

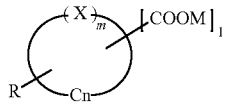

In the Formula (1), X represents O, CO, NH, $NR_1$, S or $SO_2$. $R_1$ represents an alkyl group and $R_1$ is preferably $CH_2$, $C_2H_5$ and $C_2H_4OH$. R represents an alkyl group and R is preferably $CH_2$, $C_2H_5$ and $C_2H_4OH$. R may be or may not be included in the Formula. X is preferably CO, NH, NR and O, and more preferably CO, NH and O. M represents a hydrogen atom, an alkali metal or amines. M is preferably H, Li, Na, K, monoethanol amine, diethanol amine or triethanol amine, is more preferably H, Na, or K, and is further preferably a hydrogen atom. n represents an integer of 3 to 7 n is preferably such a number that a heterocyclic ring is a six-membered ring or five-membered ring, and is more preferably such a number that the heterocyclic ring is a five-membered ring m represents 1 or 2. A compound represented by the Formula (1) may be a saturated ring or an unsaturated ring when the compound is the heterocyclic ring. l represents an integer of 1 to 5.

Specific examples of the compound represented by the Formula (1) include the compound having any of furan, pyrrole, pyrroline, pyrrolidone, pyrone, thiophene, indole, pyridine, and quinoline structures, and furthermore, having a carboxyl group as a functional group. Specific examples of the compound include 2-pyrrolidone-5-carboxylic acid, 4-methyl-4-pentanolido-3-carboxylic acid, furan carboxylic acid, 2-benzofuran carboxylic acid, 5-methyl-2-furan carboxylic acid, 2,5-dimethyl-3-furan carboxylic acid, 2,5-furan dicarboxylic acid, 4-butanolido-3-carboxylic acid, 3-hydroxy-4-pyrone-2,6-dicarboxylic acid, 2-pyrone-6-carboxylic acid, 4-pyrone-2-carboxylic acid, 5-hydroxy-4-pyrone-5-carboxylic acid, 4-pyrone-2,6-dicarboxylic acid, 3-hydroxy-4-pyrone-2,6-dicarboxylic acid, thiophene carboxylic acid, 2-pyrrole carboxylic acid, 2,3-dimethyl pyrrole-4-carboxylic acid, 2,4,5-trimethyl pyrrole-3-propionic acid, 3-hydroxy-2-indole carboxylic acid, 2,5-dioxo-4-methyl-3-pyrroline-3-propionic acid, 2-pyrrolidine carboxylic acid, 4-hydroxyproline, 1-methylpyrrolidine-2-carboxylic acid, 5-carboxy-1-methyl pyrrolidine-2-acetic acid, 2-pyridine carboxylic acid, 3-pyridine carboxylic acid, 4-pyridine carboxylic acid, pyridine dicarboxylic acid, pyridine tricarboxylic acid, pyridine pentacarboxylic acid, 1,2,5,6-tetrahydro-1-methyl nicotinic acid, 2-quinoline carboxylic acid, 4-quinoline carboxylic acid, 2-phenyl-4-quinoline carboxylic acid, 4-hydroxy-2-quinoline carboxylic acid, and 6-methoxy-4-quinoline carboxylic acid.

Preferable examples of the organic acid includes citric acid, glycine, glutamic acid, succinic acid, tartaric acid, phthalic acid, pyrrolidone carboxylic acid, pyrone carboxylic acid, pyrrole carboxylic acid, furan carboxylic acid, pyridine carboxylic acid, coumalic acid, thiophene carboxylic acid, nicotinic acid, or derivatives or salts of compounds thereof. The organic acid is more preferably pyrrolidone carboxylic acid, pyrone carboxylic acid, pyrrole carboxylic acid, furan carboxylic acid, pyridine carboxylic acid, coumalic acid, thiophene carboxylic acid, nicotinic acid, or derivatives or salts of compounds thereof. The organic acid is further preferably pyrrolidone carboxylic acid, pyrone carboxylic acid, furan carboxylic acid, coumalic acid, or derivatives or salts of compounds thereof.

An organic amine compound may be any of a primary amine, secondary amine, tertiary amine, quaternary amine or salts thereof. Specific examples of the organic amine compound include a tetraalkyl ammonium, alkylamine, benzalconium, alkylpyridium, imidazolium, polyamine and derivatives or salts thereof. Specific examples of the organic amine compound include amyl amine, butyl amine, propanol amine, propyl amine, ethanol amine, ethyl ethanol amine, 2-ethyl hexyl amine, ethyl methyl amine, ethyl benzyl amine, ethylene diamine, octyl amine, oleyl amine, cyclooctyl amine, cyclobutyl amine, cyclopropyl amine, cyclohexyl amine, diisopropanol amine, diethanol amine, diethyl amine, di-2-ethylhexyl amine, diethylene triamine, diphenyl amine, dibutyl amine, dipropyl amine, dihexyl amine, dipentyl amine, 3-(dimethyl amino)propyl amine, dimethyl ethyl amine, dimethyl ethylene diamine, dimethyl octyl amine, 1,3-dimethyl butyl amine, dimethyl-1,3-propane diamine, dimethyl hexyl amine, amino butanol, amino propanol, amino propane diol, N-acetyl amino ethanol, 2-(2-amino ethyl amino)-ethanol, 2-amino-2-ethyl-1,3-propane diol, 2-(2-amino ethoxy) ethanol, 2-(3,4-dimethoxy phenyl) ethyl amine, cetyl amine, triisopropanol amine, triisopentyl amine, triethanol amine, trioctyl amine, trityl amine, bis(2-aminoethyl) 1,3-propane diamine, bis(3-aminopropyl)ethylene diamine, bis(3-aminopropyl) 1,3-propane diamine, bis(3-amino propyl)methyl amine, bis(2-ethyl hexyl)amine, bis(trimethyl silyl)amine, butyl amine, butyl isopropyl amine, propane diamine, propyl diamine, hexyl amine, pentyl amine, 2-methyl-cyclohexyl amine, methyl-propyl amine, methyl benzyl amine, monoethanol amine, lauryl amine, nonyl amine, trimethyl amine, triethyl amine, dimethyl propyl amine, propylene diamine, hexamethylene diamine, tetraethylene pentamine, diethyl ethanol amine, tetramethyl ammonium chloride, tetraethyl ammonium bromide, dihydroxy ethyl stearyl amine, 2-heptadecenyl-hydroxyethyl imidazoline, lauryl dimethyl benzyl ammonium chloride, cetylpyridinium chloride, stearamid methyl pyridium chloride, diaryl dimethyl ammonium chloride polymer, diaryl amine polymer, and monoaryl amine polymer.

More preferably, there are used triethanol amine, triisopropanol amine, 2-amino-2-ethyl-1,3-propanediol, ethanol amine, propane diamine, and propyl amine as the organic amine compound.

Among these aggregating agents, polyvalent metal salts, such as $Ca(NO_3)$, $Mg(NO_3)$, $Al(OH_3)$, a polyaluminum chloride, and the like are preferable.

The aggregating agents may be used alone or a two or more kinds of the aggregating agents may be mixed and used. The content of the aggregating agent is preferably 0.01% by mass to 30% by mass, more preferably 0.1% by mass to 15% by mass, and further preferably 1% by mass to 15% by mass.

Preferably, a releasing agent is contained in the ink receptive particles in the embodiments of the invention. It is hence possible to transfer or fix the ink receptive particles onto the recording medium in a manner of oilless. The releasing agent may be contained in the liquid absorbing resin, or the releasing agent particles may be contained by composite it together with particles of liquid absorbing resin.

Examples of such releasing agent include low molecular polyolefins such as polyethylene, polypropylene, polybutene, or the like; silicones having softening point by heating; fatty acid amides such as oleic amide, erucic amide, ricinoleic amide, stearic amide, or the like; vegetable wax such as carnauba wax, rice wax, candelilla wax, Japan wax, jojoba oil, or the like; animal wax such as beeswax, or the like; mineral or petroleum wax such as montan wax, ozokerite, ceresin, paraffin wax, microcrystalline wax, Fischer-Tropsch wax, or the like; and modifications thereof. Among them, crystalline compound is preferred.

External additives may be also added to the ink receptive particles in the embodiments of the invention. By adding the external additives, ink receptive particles are provided with powder fluidity, charging and conductive control, liquid absorbing control, and the like. Examples of the external additives include inorganic fine particles (colorless, pale color or white particles, for example, colloidal silica, alumina, calcium carbonate, zinc oxide, titanium oxide, tin oxide, cerium oxide, carbon black, or the like), resin particles (vinyl resin, polyester, silicone particles, or the like), and the like. Particles of these external additives may be either hydrophobic or hydrophilic, and may contain specific functional groups (for example, amino group or fluorine system) on the surface by treating the surface of the particles with a coupling agent (for example, silane coupling agent). Particle size of the external additives is preferably 5 nm to 100 nm, or more preferably 10 to 50 nm as expressed by volume average particle diameter.

Such ink receptive particles 16 are secondary particles that are aggregated weakly porous particles 16F capable of absorbing and retaining ink droplets 20A, and fixing property particles (resin particles) 16E having weak ink absorbing and fixing property, and have gaps 16G between the porous particles 16F and fixing property particles 16E.

For a method of forming a particle layer 16A by the ink receptive particles 16 is a method that the ink receptive particles 16 are charged and the charged particles are supplied onto the surface of intermediate transfer body 12 by electric field, that is, xerographic method, charging property is required in the ink receptive particles 16. Accordingly, a charging control agent for toner may be internally added to the ink receptive particles 16. Further, in order to fix (trap) a coloring material (particularly pigment) in ink on the surface of porous particles 16F and fixing particles 16E (primary particles), pigment and water-soluble polymer are preferred to be insoluble so as to react with ink receptive particles.

Further, the ink receptive particles 16 have a function of fixing the image when transferred or after transferred on the recording medium 8. For the purpose of fixing, transfer and fixing is carried out by pressure or heat, or pressure and heat using a transfer fixing roll 22. In addition, in order to obtain color formation of ink after forming an image (in order to visually recognize the image through a layer 16C formed on an image layer 16B), the ink receptive particles 16 must be transparent at least after fixing.

<Intermediate Transfer Body>

The intermediate transfer body 12 on which the ink receptive particle layer is formed may be either belt as in the first embodiment, or cylindrical (drum) as in the fourth embodiment. To supply and hold ink receptive particles on the surface of intermediate transfer body by an electrostatic force, the outer circumferential surface of the intermediate transfer body must have particle holding property of semiconductive or insulating properties. As electric characteristics for the surface of the intermediate transfer body, it is required to use a material having surface resistance of 10E10 to 14 ohms/square and volume resistivity of 10E9 to 13 ohm-cm in the case of the semiconductive property, and surface resistance of 10E14 ohms/square and volume resistivity of 10E13 ohm-cm in the case of the insulating property.

In the case of belt shape, the base material is not particularly limited as far as it is capable of rotating and driving a belt in the apparatus and has the mechanical strength needed to withstand the rotating and driving, and it has the heat resistance needed to withstand heat when heat is used in transfer/fixing. Specific examples of the substrate are polyimide, polyamide imide, aramid resin, polyethylene terephthalate, polyester, polyether sulfone, and stainless steel.

In the case of drum shape, the base material includes aluminum or stainless steel or the like.

To enhance transfer efficiency of the ink receptive particles 16 (for efficient transfer from intermediate transfer body 12 to recording medium 8), preferably, a releasing layer 14A is formed on the surface of intermediate transfer body 12. The releasing layer 14A may be formed either as surface (material) of the intermediate transfer body 12, or the releasing layer 14A may be formed on the surface of the intermediate transfer body 12 according to the manner of on-process by adding externally.

The releasing layer is composed of silicone oil, modified silicone oil, fluorine based oil, hydrocarbon based oil, mineral oil, vegetable oil, polyalkylene glycol oil, alkylene glycol ether, alkane diol, fused wax, or the like.

That is, when the surface of intermediate transfer body 12 is a releasing layer 14A, it is preferred to use fluorine based resins such as tetrafluoroethylene-ethylene copolymer, polyvinylidene fluoride, tetrafluoroethylene-perfluoroalkyl vinyl ether copolymer, tetrafluoroethylene-hexafluoropropylene copolymer, or the like, or elastic materials such as silicone rubber, fluorosilicone rubber, or phenyl silicone rubber.

When forming the releasing layer 14A by external addition, an aluminum of which surface is anodized is used in the case of drum shape, or the same base materials as those for the belt is used in the case of belt shape, or when an elastic material is formed (for either drum shape or belt shape), silicone rubber, fluorosilicone rubber, phenyl silicone rubber, fluororubber, chloroprene rubber, nitrile rubber, ethylene propylene rubber, styrene rubber, isoprene rubber, butadiene rubber, ethylene propylene butadiene rubber, and nitrile butadiene rubber.

When using silicone rubber, if silicone oil is used as a lubricant, the silicone rubber is swollen, and to prevent the swollen of the silicone rubber, it is preferred to provide the surface of silicone rubber with a coating layer of fluorine resin or fluorine rubber.

Supply method of releasing layer 14 includes a method of forming a releasing layer 14A by furnishing an oil tank, supplying oil into an oil application member, and supplying oil on the surface of intermediate transfer body 12 by the application member, and a method of forming a releasing layer 14A on the surface of intermediate transfer body 12 by an applied member impregnated with oil.

In order to apply heating system by electromagnetic induction to the fixing process in the transfer fixing roll 22, a heat generating layer may be formed on the intermediate transfer body 12. The heat generating layer is made of a metal causing electromagnetic induction action. For example, nickel, iron, copper, aluminum or chromium may be used selectively.

<Particle Supply Process>

On the surface of the intermediate transfer body 12, an ink receptive particle layer 16A of ink receptive particles 16 is formed. At this time, as the method of forming an ink receptive particle layer 16A of the ink receptive particles 16, a general method of supplying an electrophotographic toner on a phosphor. That is, a charge is supplied in advance on the surface of intermediate transfer body 12 by general charging for an electrophotographic method (charging by a charging device 28 or the like). The ink receptive particles 16 are frictionally charged so as to make a counter charge to the charge on the surface of the intermediate transfer body 12 (one-component frictional charging method or two-component method).

Ink receptive particles 16 held on the supply roll 18A in FIG. 2A form an electric field together with the surface of intermediate transfer body 12, and are moved/supplied onto the intermediate transfer body 12 and held thereon by an electrostatic force. At this time, according to the thickness of image layer 16B formed on the particle layer 16A of the ink receptive particles 16 (depending on an amount of the ink to be applied), the thickness of particle layer 16A of the ink receptive particles 16 can be also controlled. The charging amount of the ink receptive particles 16 is preferred to be in a range of 5 μc/g to 50 μc/g.

A particle supply process corresponding to one-component development system will be explained below.

The ink receptive particles 16 are supplied on a particle supply roll 18A, and charged by a charging blade 18B while the thickness of particle layer is regulated.

The charging blade 18B has a function of regulating the layer thickness of the ink receptive particles 16 on the surface of the particle supply roll 18A, and can change the layer thickness of the ink receptive particles 16 on the surface of the supply roll 18A by varying the pressure on the particle supply roll 18A. By controlling the layer thickness of the ink receptive particles 16 on the surface of the particle supply roll 18A to substantially one layer, the layer thickness of the ink receptive particles 16 formed on the surface of the intermediate transfer body 12 can be formed in substantially one layer. By controlling the pressing force on the charging blade 18B to be low, the layer thickness of the ink receptive particles 16 formed on the surface of the supply roll 18A can be increased, and the thickness of particle layer 16A of the ink receptive particles 16 formed on the surface of the intermediate transfer body 12 can be increased.

In other method, assuming that both of the peripheral speed of intermediate transfer body 12 and particle supply roll 18A forming approximately one layer of particles on the surface of intermediate transfer body 12 are 1, by increasing the peripheral speed of particle supply roll 18A, the number of ink receptive particles 16 supplied on the intermediate transfer body 12 can be increased, and it can be controlled so as to increase the thickness of particle layer 16A on the intermediate transfer body 12. Further, the layer thickness can be regulated by combining the above methods. In this configuration, for example, the ink receptive particles 16 are charged negatively, and the surface of intermediate transfer body 12 is charged positively.

By thus controlling the layer thickness of ink receptive particle layer 16A, consumption of ink receptive particle layer 16A is suppressed, and a pattern of which the surface consistently covered with a protective layer may be formed.

As the charging roll 18 in the charging device, it is possible to use a roll of 10 to 25 mm in diameter, having an elastic layer dispersed with a conductive material on the outer surface of bar or pipe member which is made of aluminum, stainless steel or the like, and having volume resistivity adjusted to approximately 10E6 to 10E8 ohm-cm.

The elastic layer includes resin material such as urethane resin, thermoplastic elastomer, epichlorhydrine rubber, ethylene-propylene-diene copolymer rubber, silicon system rubber, acrylonitrile-butadiene copolymer rubber, or polynorbornene rubber, and these resin materials may be used alone or a mixture of two or more resin materials may be used. A preferred material is a foamed urethane resin.

The foamed urethane resin is preferably a resin having closed cell structure formed by mixing and dispersing a hollow body such as hollow glass beads or microcapsules of thermal expansion type in a urethane resin. Such foamed urethane resin has a low hardness elasticity preferred for charging device, and also has a high contact stability on conveying belt, and is excellent in nip forming property.

Further, the surface of elastic layer may be coated with a water repellent skin layer of 5 to 100 μm in thickness, and it is effective for suppressing characteristic changes (changes in resistance value) due to humidity changes in the apparatus or sticking of ink mist to the charging layer surface.

A DC power source is connected to the charging device 28, and a driven roll 31 is electrically connected to the frame ground. The charging device 28 is driven while the intermediate transfer body 12 is placed between the charging device 28 and the driven roll 31. At the pressing position, since a specified potential difference is generated between the charging device 28 and the grounded driven roll 31, an electrical charge can be applied.

<Marking Process>

Ink droplets 20A are ejected from the ink jet recording head 20, based on an image signal, on the layer (particle layer 16A) of ink receptive particles 16 formed on the surface of intermediate transfer body 12, and an image is formed. Ink droplets 20A ejected from the ink jet recording head 20 are implanted in the particle layer 16A of the ink receptive particles 16, and ink droplets 20A are quickly absorbed in the gaps 16G formed between the ink receptive particles 16, and the solvent is sequentially absorbed in the voids of porous particles 16F and fixing particles 16E, and the pigment (coloring material) is trapped on the surface of primary particles (porous particles 16F, fixing particles 16E) forming the ink receptive particles 16.

In this case, preferably, it is desired to trap plural pigments near the surface of particle layer 16A of ink receptive particles 16. This is realized when gaps between the primary particles composing secondary particles have filter effects to trap the pigment near the surface of particle layer 16A, and the pigment also is trapped and fixed on the surface of primary particles.

To trap the pigment securely near the surface of particle layer 16A and on the surface of primary particles, a method in which the ink may react with ink receptive particles 16, and hence, the pigment may be quickly made insoluble (aggregated) can be adopted. Specifically, this reaction may be realized by reaction between ink and polyhydric metal salt, or pH reaction type.

To write an image at high speed, a line type ink jet recording head (FWA) having a width corresponding to a paper width is preferred, however by using a conventional scan type ink jet recording head, images may be formed sequentially on the particle layer formed on the intermediate transfer body. The ink ejecting unit of ink jet recording head 20 is not particularly limited as far as it is a unit capable of ejecting ink, such as piezoelectric element drive type, or heater element drive type, or the like. The ink itself may be ink using conventional dyes as a coloring material, however pigment ink is preferable.

When the ink receptive particles 16 react with the ink, the ink receptive particles 16 are treated with an aqueous solution containing a polyhydric metal salt which has effects of aggregating the pigment by reacting with ink, and dried before use Specific examples of polyhydric metal salt include aluminum chloride, aluminum bromide, aluminum sulfide, aluminum nitrate, barium chloride, barium bromide, barium iodide, barium oxide, barium nitrate, barium thiocyanate, calcium chloride, calcium bromide, calcium iodide, calcium nitrite, calcium nitrate, calcium dihydrogenphosphate, calcium thiocyanate, calcium benzoate, calcium acetate, calcium salicylate, calcium tartate, calcium lactate, calcium fumarate, calcium citrate, copper chloride, copper bromide, copper sulfate, copper nitrate, copper acetate, iron chloride, iron bromide, iron iodide, iron sulfate, iron nitrate, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogenphosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, zinc acetate, and other compounds.

When the ink receptive particles 16 react with the ink, they may be treated with an aqueous solution containing an organic acid which has an effect on the aggregation of pigment by reacting with the ink, and dried before use.

Preferred examples of organic acid include citric acid, glycine, glutamic acid, succinic acid, tartaric acid, phthalic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, or derivatives or salts of these compounds. More preferred examples are pyrrolidone carboxylic acid, pyrone carboxylic acid, pyrrole carboxylic acid, furan carboxylic acid, pyridine carboxylic acid, coumaric acid, thiophene carboxylic acid, nicotinic acid, or derivatives or salts of these compounds. Still more preferred examples are pyrrolidone carboxylic acid, pyrone carboxylic acid, furan carboxylic acid, coumaric acid, or derivatives or salts of these compounds.

<Ink>

The coloring material of ink used in reaction may be either dye or pigment, however pigment is preferred. Compared with dye, pigment is more likely to be aggregated at the time of reaction. Among pigments, a pigment dispersed with a high molecular dispersant, a self-dispersable pigment, or a pigment coated with resin are preferred.

A preferred ink in the ink set for ink jet in the embodiments of the invention is ink containing a resin (water-soluble high polymer, etc.) having a carboxylic group which has an effect on the aggregation of pigment by reacting with polyhydric metal salt or organic acid.

Examples for the Ink are as Follows:

(Black Ink)

—Composition—

Mogul L (manufactured by Cabot Corporation) (without pigment/surface functional group), 4% by mass
Styrene-acrylic acid-sodium acrylate copolymer: 0.6% by mass
Diethylene glycol: 15% by mass
Diglycerin ethylene oxide adduct: 5% by mass
Polyoxyethylene-2-ethylhexyl ether: 0.75% by mass
Ion exchange water: balance The pH of this liquid is 8.2, volume-average particle size is 120 nm, surface tension is 32 mN/m, and viscosity is 3.3 mPa·s.

(Cyan Ink)

—Composition—

C.I. Pigment Blue 15:3: 4% by mass
Styrene-acrylic acid-sodium acrylate copolymer: 0.6% by mass
Diethylene glycol: 20% by mass
Glycerin: 5% by mass
Acetylene glycol ethylene oxide adduct: 1% by mass
Ion exchange water: balance The pH of this liquid is 8.8, volume-average particle size is 92 nm, surface tension is 31 mN/m, and viscosity is 3.1 mPa·s.

(Magenta Ink)

—Composition—

C.I. Pigment Red 122: 4% by mass
Styrene-acrylic acid-sodium acrylate copolymer: 0.75% by mass
Diethylene glycol: 20% by mass
Glycerin: 5% by mass
Acetylene glycol ethylene oxide adduct: 1% by mass
Ion exchange water: balance The pH of this liquid is 8.6, volume-average particle size is 106 nm, surface tension is 31 mN/m, and viscosity is 3.2 mPa·s.

(Yellow Ink)

—Composition—

C.I. Pigment Yellow 128: 4% by mass
Styrene-acrylic acid-sodium acrylate copolymer: 0.6% by mass
Diethylene glycol: 20% by mass
Glycerin: 5% by mass
Acetylene glycol ethylene oxide adduct: 1% by mass
Ion exchange water: balance The pH of this liquid is 8.7, volume-average particle size is 115 nm, surface tension is 31 mN/m, and viscosity is 3.2 mPa·s.

<Transfer Process>

The ink receptive particle layer 16A which receives ink drops 20A is transferred and fixed on the recording medium 8, thereby an image is formed on the recording medium 8. The transfer and fixing may be done in separate processes, however the transfer and the fixing is preferably done at the same time. The fixing may be effected by any one of heating or pressing methods of the ink receptive particle layer 16A, or by using both method of heating and pressing methods, or preferably by heating and pressing at the same time.

In the method conducting the heating/pressing, for example, the heating and fixing device (fuser) for electrophotography as shown in FIG. 4B can be applied. By controlling heating/pressing, the surface properties of ink receptive particle layer 16A can be controlled, and the degree of gloss can be controlled. After heating/pressing, when removing the recording medium 8 on which an image is transferred from the intermediate transfer body 12, it may be removed off after cooling of the ink receptive particle layer 16A. The cooling method includes natural cooling and forced cooling such as air-cooling. In these processes, the intermediate transfer body 12 is preferred to be of belt shape.

The ink image is formed on the surface layer of ink receptive particles 16 formed on the intermediate transfer body 12 (the pigment is trapped near the surface of ink receptive particle layer 16A), and transferred on the recording medium 8, and therefore, the ink image is formed so as to be protected by the particle layer 16C composed of ink receptive particles 16. That is, since a lot of pigments (coloring materials) are not present on the outmost layer transferred on the recording medium 8, effects of image disturbance by rubbing or the like can be prevented.

The ink solvent received/held in the layer of ink receptive particles 16 is held in the layer of ink receptive particles 16 after transfer and fixing, and removed by natural drying as the same in drying of ink solvent in ordinary water-based ink jet recording.

<Cleaning Process>

To allow the repetitive use by refreshing the surface of intermediate transfer body 12, a process of cleaning the surface of intermediate transfer body 12 by a cleaning device 24 is needed. The cleaning device 24 consists of a cleaning part and a recovery part for conveying particles (not shown), and by the cleaning process, the ink receptive particles 16 (residual particles 16D) remaining on the surface of intermediate transfer body 12, and deposits sticking to the surface of intermediate transfer body 12 such as foreign matter (paper dust or the like of recording medium 8) other than particles can be removed. The collected residual particles 16D may be recycled.

<Neutralizing Process>

Depending on the conditions of temperature or humidity, the surface resistance of intermediate transfer body 12 may be inappropriate value. When the surface of intermediate transfer body 12 is at high resistance, during supply of particles is carried out repeatedly, an electric charge may be accumulated on the surface of the intermediate transfer body 12 to increase the potential, and adverse effects on formation of particle layer may occur.

Before forming the releasing layer 14A, the surface of the intermediate transfer body 12 may be neutralized by using a neutralization apparatus 29. As a result, the electric charge accumulated on the surface of the intermediate transfer body 12 is removed, and effects on formation of ink receptive particle layer 16A can be suppressed.

Other Embodiments

In the foregoing embodiments, ink droplets 20A are selectively ejected from the ink jet recording heads 20 in black, yellow, magenta, and cyan colors on the basis of image data, and a full-color image is recorded on the recording medium 8. However, the invention is not limited to the recording of characters or image on recording medium. That is, the pattern forming apparatus of the invention can be applied generally in liquid droplet ejection (spraying) apparatuses used industrially.

For example, the recording material of liquid droplets to be ejected is not limited to pigment, dye or coloring material. For example, a recording material emitting fluorescent light when irradiated with ultraviolet ray may be used. Or magnetic material (powder) may be used.

What is claimed is:

1. A pattern forming process comprising:

forming a liquid receptive particle layer on an intermediate transfer body within a specified area by using liquid receptive particles capable of receiving a recording liquid containing a recording material, the liquid receptive particle layer forming including charging a specified area in a sub-scanning direction that is the conveying direction of the intermediate transfer body and forming the liquid receptive particle layer in the charged specified area;

arranging a plurality of charging units aligned in a main scanning direction that is orthogonal to the conveying direction of the intermediate transfer body and selecting a charging area and a non-charging area in the main scanning direction by selecting between charging and non-charging in every charging unit;

applying a liquid droplet of the recording liquid onto a specified position of liquid receptive particle layer according to specified data, trapping the recording material near the surface of the liquid receptive particle layer on the intermediate transfer body, and forming a pattern on the recording material, wherein the specified area for forming the liquid receptive particle layer is an area where the pattern is formed; and removing from the intermediate transfer body the liquid receptive particle layer provided with the recording liquid and transferring the liquid receptive particle layer to a transfer object so that the pattern is between the transfer object and the liquid receptive particle layer.

2. The pattern forming process of claim 1, wherein in the forming of a liquid receptive particle layer, a plurality of the liquid receptive particles are stacked to form the liquid receptive particle layer of multiple particle thickness.

3. The pattern forming process of claim 2, wherein in the forming of a liquid receptive particle layer, the liquid receptive particle layer of a specific thickness depending on the specified data is formed.

4. The pattern forming process of claim 1, wherein the specified area for forming the liquid receptive particle layer is an area where the liquid receptive particle layer provided with the recording liquid is removed from the intermediate transfer body and transferred to the transfer object.

5. The pattern forming process of claim 1, wherein the liquid receptive particle layer forming comprises:

charging the intermediate, transfer body; and supplying the liquid receptive particles in a specified area in a sub-scanning direction that is the conveying direction of the intermediate transfer body and forming the liquid receptive particle layer.

6. The pattern forming process of claim 5 further comprising:

supplying the liquid receptive particles in a specified area in a main scanning direction that is a direction orthogonal to the conveying direction of the intermediate transfer body.

7. A pattern forming apparatus comprising:

an intermediate transfer body;

a particle supply unit that supplies liquid receptive particles capable of receiving a recording liquid containing a recording material and trapping the recording material at the surface of the liquid receptive particles, and forms a liquid receptive particle layer of specified layer thickness within a specified area on the intermediate transfer body;

the particle supply unit including a charging unit that charges in a specified area in a sub-scanning direction that is the conveying direction of the intermediate transfer body, and a particle layer forming unit that forms the liquid receptive particle layer in the charged specified area;

the charging unit having a plurality of charging units arranged aligned in the main scanning direction that is orthogonal to the conveying direction of the intermediate transfer body and is capable of selecting charging and non-charging in every charging unit;

a liquid droplet ejecting unit that applies a liquid droplet of the recording liquid onto the liquid receptive particle layer according to specified data, and forms a pattern of the recording material near the surface of the liquid receptive particle layer, the specified area for forming the liquid receptive particle layer being an area of forming the pattern by the liquid droplet ejecting unit; and a transfer unit that transfers the liquid receptive particle layer containing the recording liquid onto a transfer object so that the pattern is held between the transfer object and the liquid receptive particle layer.

8. The pattern forming apparatus of claim 7, wherein the specified area for forming the liquid receptive particle layer is an area of transferring onto the transfer object by the transfer unit.

9. The pattern forming apparatus of claim 7, wherein the particle supply unit comprises:

a charging unit that charges the intermediate transfer body; and a particle layer forming unit that supplies the liquid receptive particles in a specified area in a sub-scanning direction that is the conveying direction of the intermediate transfer body and forms a liquid receptive particle layer.

10. The pattern forming apparatus of claim 9, wherein the particle layer forming unit comprises:

a supply roller, provided opposite to the intermediate transfer body and that carries the liquid receptive particles; and a regulating unit that supplies the liquid receptive particles from the supply roller, in a specified area in the main scanning direction that is a direction orthogonal to the conveying direction of the intermediate transfer body.

11. The pattern forming apparatus of claim 10, wherein the regulating unit further controls the layer thickness of the liquid receptive particle layer.

12. The pattern forming apparatus of claim 10, wherein the layer thickness of the liquid receptive particle layer is controlled by regulating the conveying speed of the intermediate transfer body and the rotating speed of the supply roller.

13. The pattern forming apparatus of claim 7, further comprising a transfer object charging unit that charges the face of the transfer object that the liquid receptive particle layer is not transferred onto.

14. The pattern forming apparatus of claim 7, further comprising:

a releasing layer forming unit that forms a releasing layer on the surface of the intermediate transfer body, wherein the particle supply unit forms the liquid receptive particle layer on the releasing layer.

* * * * *